US011352779B2

(12) United States Patent
Newbrough

(10) Patent No.: US 11,352,779 B2
(45) **Date of Patent: *Jun. 7, 2022**

(54) ADJUSTABLE ANCHOR FOR CURTAIN-WALL SYSTEM

(71) Applicant: Oldcastle BuildingEnvelope Inc., Terrell, TX (US)

(72) Inventor: Tim Newbrough, Terrell, TX (US)

(73) Assignee: Oldcastle BuildingEnvelope, Inc., Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/098,839

(22) Filed: Nov. 16, 2020

(65) Prior Publication Data

US 2021/0062498 A1 Mar. 4, 2021

Related U.S. Application Data

(63) Continuation of application No. 16/544,466, filed on Aug. 19, 2019, now Pat. No. 10,865,559.

(60) Provisional application No. 62/842,227, filed on May 2, 2019, provisional application No. 62/720,628, filed on Aug. 21, 2018.

(51) Int. Cl.

| | |
|---|---|
| ***E04B 1/41*** | (2006.01) |
| ***E04B 2/88*** | (2006.01) |
| *E04B 1/38* | (2006.01) |

(52) U.S. Cl.

CPC ..... *E04B 1/41* (2013.01); *E04B 2/88* (2013.01); *E04B 2001/405* (2013.01)

(58) Field of Classification Search

CPC ..... E04B 1/41; E04B 2/88; E04B 2001/405; E04B 2/92

See application file for complete search history.

(56) References Cited

U.S. PATENT DOCUMENTS

| | | | | |
|---|---|---|---|---|
| 6,658,804 | B2 ‡ | 12/2003 | Leytes | E04B 2/885 52/1 |
| 9,416,529 | B1 | 8/2016 | Jeske | |
| 9,677,265 | B2 ‡ | 6/2017 | Moeller | E04B 2/88 |
| 10,590,644 | B2 ‡ | 3/2020 | Naylor | E04B 2/721 |

FOREIGN PATENT DOCUMENTS

| | | | |
|---|---|---|---|
| WO | WO-2002040801 | A1 ‡ | 5/2002 |
| WO | WO-2017147280 | A1 ‡ | 8/2017 |

‡ imported from a related application

*Primary Examiner* — Patrick J Maestri

(74) *Attorney, Agent, or Firm* — Henry Patent Law Firm PLLC

(57) ABSTRACT

A curtain-wall anchor includes a back member having a first arcuate slotted aperture and a second aperture formed therein. The first arcuate slotted aperture receives a first mounting bolt and the second aperture receives a second mounting bolt. A first plurality of vertically-oriented ridges are formed in the back member proximate the first arcuate slotted aperture and the second aperture. A first locking washer is received onto the first mounting bolt. The first locking washer includes a second plurality of vertically-oriented ridges that are complementary to the first plurality of vertically-oriented ridges formed in the back member. The first arcuate slotted aperture facilitates angular adjustment of the back member. Engagement of the second plurality of vertically-oriented ridges with the first plurality of vertically-oriented ridges facilitates securement of the back member in a select angular position.

17 Claims, 35 Drawing Sheets

ADJUSTABLE ANCHOR FOR CURTAIN-WALL SYSTEM

CROSS-REFERENCE TO RELATED APPLICATIONS

This application is a continuation of U.S. patent application Ser. No. 16/544,466, filed on Aug. 19, 2019. U.S. patent application Ser. No. 16/544,466 claims priority to U.S. Provisional Patent Application No. 62/720,628, filed on Aug. 21, 2018 and U.S. Provisional Patent Application No. 62/842,227, filed on May 2, 2019. U.S. patent application Ser. No. 16/544,466, U.S. Provisional Patent Application No. 62/720,628, and U.S. Provisional Patent Application No. 62/842,227 are each incorporated herein by reference.

TECHNICAL FIELD

The present disclosure relates generally to architectural curtain-wall systems and, more particularly, but not by way of limitation to an adjustable anchoring mechanism ("anchor") for a curtain wall system.

BACKGROUND

This section provides background information to facilitate a better understanding of the various aspects of the disclosure. It should be understood that the statements in this section of this document are to be read in this light, and not as admissions of prior art.

Curtain walls are frequently utilized in architecture and construction projects. A curtain wall is one type of outer covering for a building that does not support the roof or floor loads. Various types of curtain wall systems exist, including captured curtain-wall systems and structural curtain-wall systems. These systems generally include a network of curtain-wall members. The curtain-wall members generally include horizontal members (e.g. transoms) and vertical members (e.g. mullions) with panel members, often glass, disposed within the network. In such systems, anchors may be used to secure the curtain-wall network to load-bearing structures that comprise the frame of the building. However, the installation of anchors is frequently complicated by as-built conditions that deviate from the design plans. As such, there is a need for adjustable anchors that are capable of correcting for these deviations in the field.

SUMMARY

This summary is provided to introduce a selection of concepts that are further described below in the detailed description. This summary is not intended to identify key or essential features of the claimed subject matter, nor is it to be used as an aid in limiting the scope of the claimed subject matter.

Various aspects of the disclosure relate to a curtain-wall anchor. The curtain-wall anchor includes a back member having a first arcuate slotted aperture and a second aperture formed therein. The first arcuate slotted aperture receives a first mounting bolt and the second aperture receives a second mounting bolt. A first plurality of vertically-oriented ridges are formed in the back member proximate the first arcuate slotted aperture and the second aperture. A first locking washer is received onto the first mounting bolt. The first locking washer includes a second plurality of vertically-oriented ridges that are complementary to the first plurality of vertically-oriented ridges formed in the back member. The first arcuate slotted aperture facilitates angular adjustment of the back member. Engagement of the second plurality of vertically-oriented ridges with the first plurality of vertically-oriented ridges facilitates securement of the back member in a select angular position.

Various aspects of the disclosure relate to a curtain-wall system. The curtain-wall system includes a building structure and a curtain-wall member. A back member is coupled to the building structure. A first arm is coupled to the back member. The first arm includes a first base member, a first intermediate member that is hingedly coupled to the first base member, and a first distal member that is hingedly coupled to the first intermediate member. The first distal member is coupled to the curtain-wall member. Articulation of the first intermediate member relative to the first base member and articulation of the first distal member relative to the first intermediate member facilitates adjustment of the curtain-wall anchor relative to an as-built location of an edge of the building structure.

One aspect of the disclosure relates to a method of installing a curtain-wall anchor. The method includes securing a back member to a building structure with a first mounting bolt that is received through a first arcuate slotted aperture formed in the back member and with a second mounting bolt that is received through a second aperture formed in the back member. The back member includes a first plurality of vertically-oriented ridges formed therein. An angular position of the back member is adjusted to a select angular position relative to the building structure using the first arcuate slotted aperture. The back member is secured in the select angular position relative to the building structure utilizing a first locking washer and a second locking washer. The first locking washer includes a second plurality of vertically-oriented ridges that are complementary to the first plurality of vertically-oriented ridges. The second locking washer includes a third plurality of vertically-oriented ridges that are complementary to the first plurality of vertically-oriented ridges. Engagement of the second plurality of vertically-oriented ridges and the third plurality of vertically-oriented ridges with the first plurality of vertically-oriented ridges impedes angular movement of the back member relative to the building structure.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

FIG. 7C is a detail view of an exterior corner of the curtain-wall system of

FIG. 7A;

DETAILED DESCRIPTION

Various embodiments will now be described more fully with reference to the accompanying drawings. The disclosure may, however, be embodied in many different forms and should not be construed as limited to the embodiments set forth herein.

Figure 1:
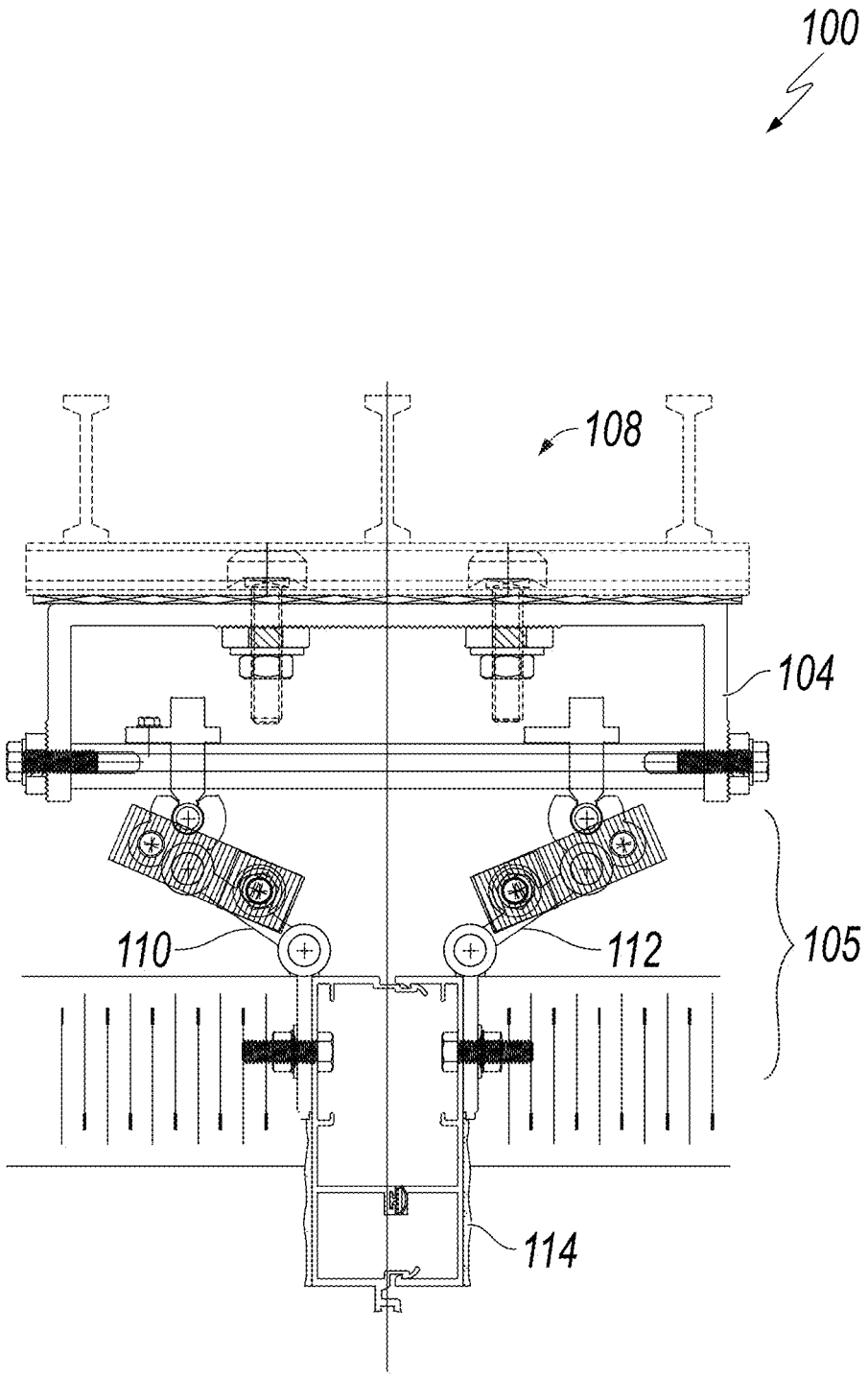
FIG. 1 is a top plan view of an exemplary curtain-wall anchor.

FIG. 1 is a top plan view of a curtain-wall anchor 100. The curtain-wall anchor 100 includes a mounting bracket 104 that abuts and is coupled to a channel 106 or other attachment capable of handling the design requirements such as, for example, through bolts, lag bolts, welded bolts, or other fasteners that may or may not be secured with plates, angles, brackets, spacers, or other connection devices. All references hereafter to "channel" (including channel 106 and channel 916) shall be understood to contemplate any and all such other attachments, whether alternatively or in addition to such "channel" or each other. In various embodiments, the channel 106 may be embedded in, or otherwise coupled to a building structure 108. In various embodiments, the building structure 108 is, for example, a composite slab constructed of, for example, concrete; however, in other embodiments, the building structure may be constructed of, for example, timber, including mass timber, or a metallic material such as, for example, steel or steel alloys that may or may not use the channel 106 for attachment. In various embodiments, the channel 106 may be coupled to the building structure 108 in any appropriate manner including, for example, cast-in-place anchors, post-installed anchors, and powder-actuated anchors. In various embodiments, the curtain-wall anchor 100 may include an arm assembly 105. The arm assembly 105 includes a first arm 110 and, in various embodiments, may include a second arm 112 operatively coupled to a front plate 402 (shown in FIG. 4). The front plate 402 is coupled to the mounting bracket 104. During operation, the first arm 110 and the second arm 112 are coupled to a vertical member 114. By way of example, FIG. 1 illustrates that the curtain-wall anchor 100 is disposed on an outwardly-facing front face of the building structure 108. However, in other embodiments, the curtain-wall anchor 100 could be coupled to an upwardly-facing top face of the building structure 108.

Figure 2A:
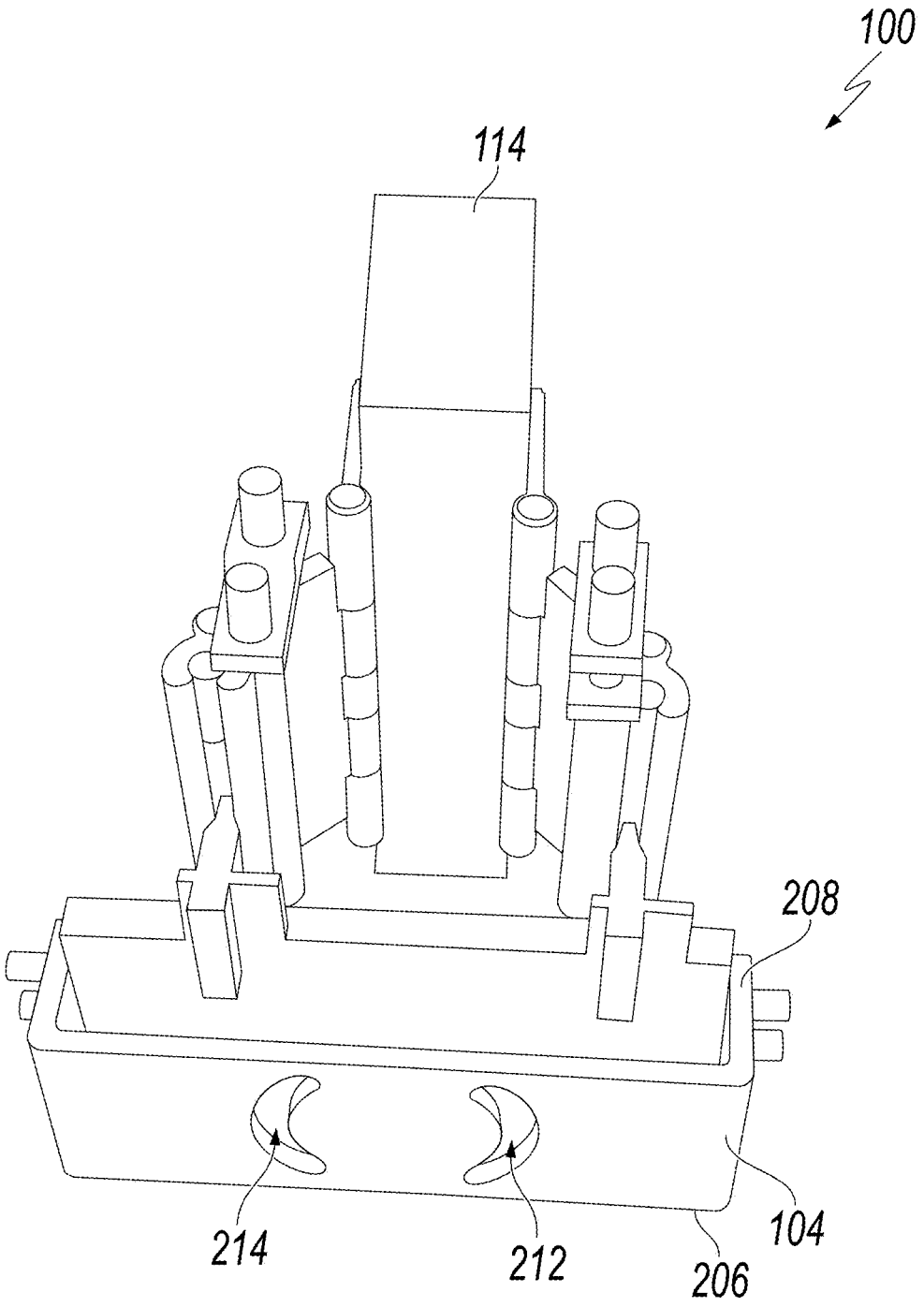
FIG. 2A is a rear perspective view of the curtain-wall anchor of FIG. 1 showing a vertical member coupled thereto.
Figure 2B:
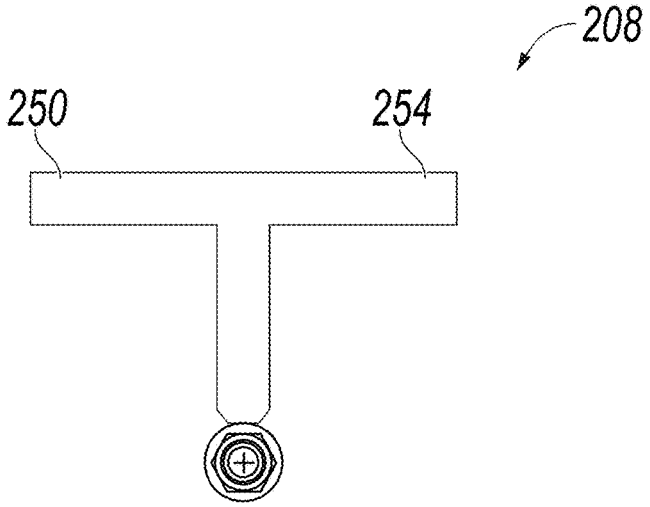
FIG. 2B is a top plan view of an exemplary flange having an interior web and an exterior web.
Figure 2C:
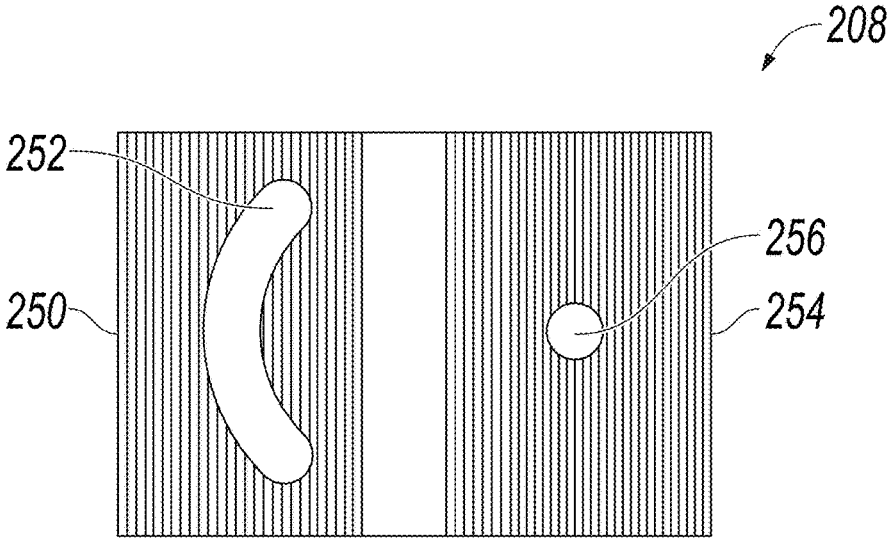
FIG. 2C is a front view of the flange of FIG. 2B.
Figure 2D:
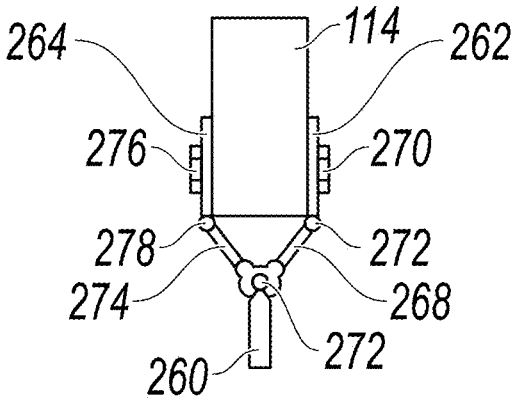
FIG. 2D is a to plan view of an exemplary curtain-wall anchor illustrating a single flange.
Figure 2E:
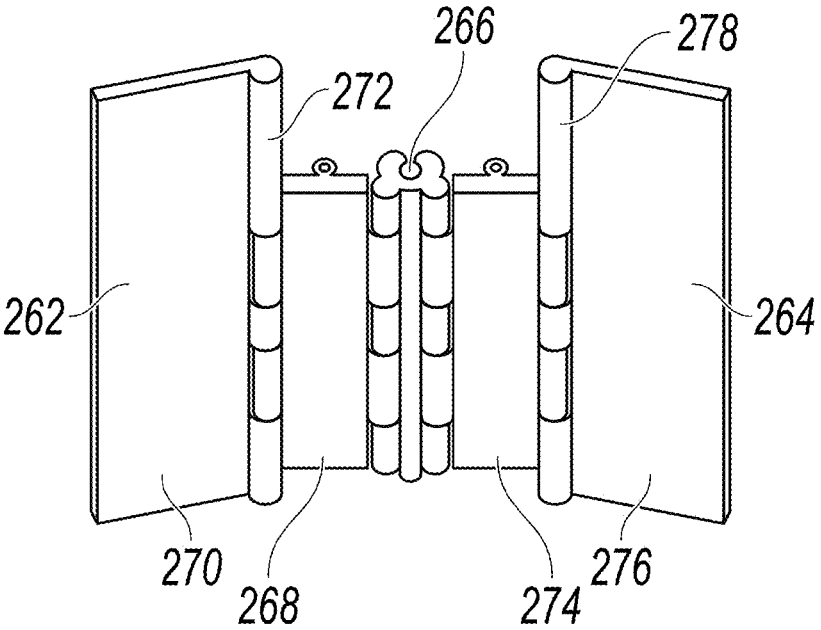
FIG. 2E is an interior view of the curtain-wall anchor of FIG. 2D.
Figure 3A:
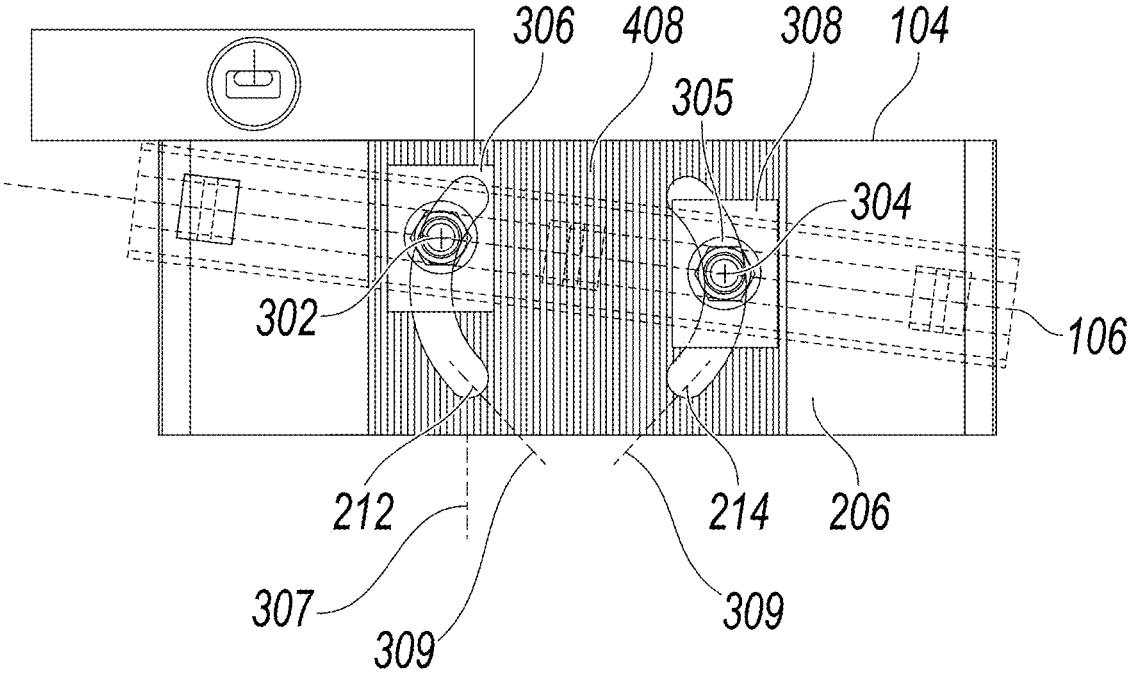
FIG. 3A is a front plan view of an exemplary mounting bracket showing a rail attached thereto.
Figure 3B:
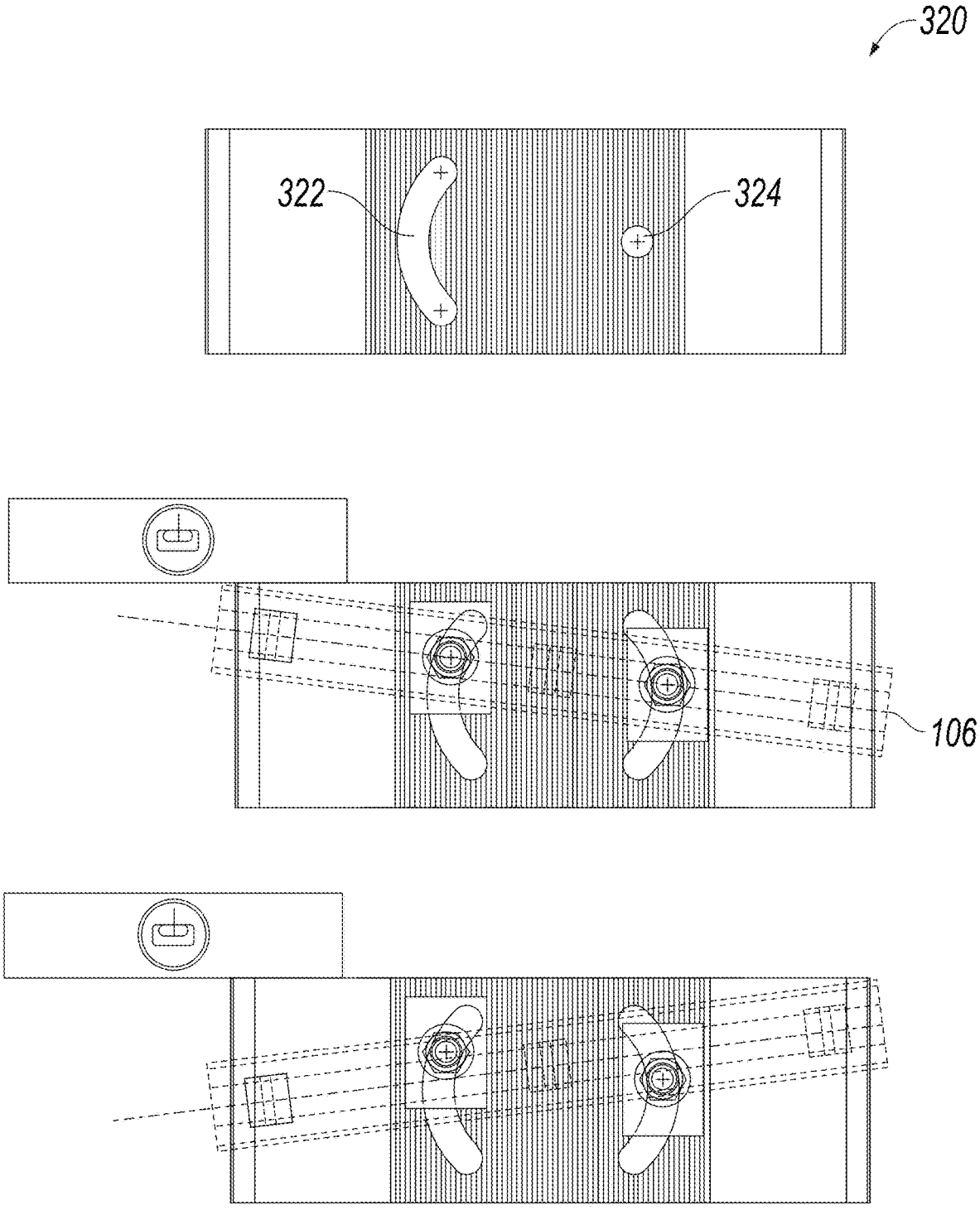
FIG. 3B is a front plan view of an exemplary mounting bracket with a single arcuate slot showing a rail attached thereto.

FIG. 2A is a rear perspective view of the curtain-wall anchor 100 showing a vertical member 114 coupled thereto. The mounting bracket 104 includes a back member 206, a first flange 208 extending from the back member 206, and a second flange 210 extending from the back member 206. FIG. 2A illustrates, by way of example, an embodiment where the first flange 208 and the second flange 210 are located at respective ends of the back member 206; however, in other embodiments, the first flange 208 and the second flange 210 could be located at any point along the back member 206. As shown in FIG. 3A, first slot 212 is formed through the back member 206. In various embodiments, a second slot 214 is also formed through the back member 206; however, in some embodiments, at least one of the first slot 212 and the second slot 214 may be omitted and replaced, for example, by a round aperture (as shown in FIG. 3B). In the embodiment shown in FIG. 3A, the first slot 212 and the second slot 214 each form an arc in the range of approximately 30 degrees to approximately 90 degrees so as to facilitate angular adjustment of the back member 206 and placement of the back member 206 in a select angular position relative to the building structure 108. The second slot 214 may or may not be a mirror image of the first slot 212 about a vertical axis disposed therebetween. In various embodiments, the first slot 212 and the second slot 214 may be optimally spaced from each other in order to maximize the load-carrying capacity of the curtain-wall anchor 100. FIG. 2A illustrates by way of example an embodiment where the first slot 212 and the second slot 214 are located between the first flange 208 and the second flange 210; however, in other embodiments, the first slot 212 and/or the second slot 214 could be located outside of the first flange 208 and the second flange 210, respectively. In still other embodiments, as shown in FIGS. 2B-2C, the first flange 208, for example, may include an interior web 250, having a slotted aperture 252, and an exterior web 254, having a round aperture 256. In such embodiments, the second flange 210 is arranged similar to the first flange 208. In other embodiments, shown, for example, in FIGS. 2D-2E, a single flange 260 extends from the back member 206 in an approximate center of the back member 206. A first arm 262 and a second arm 264 extend from the flange 260. In various embodiments, the first arm 262 and the second arm 264 may be coupled to the flange via a hinge 266. In such embodiments, the hinge 266 facilitates angular adjustment of the first arm 262 and the second arm 264 relative to each other and relative to the single flange 260 in an effort to accommodate vertical members of varying thicknesses. The first arm 262 includes a first proximal member 268, which is coupled to the single flange 260 via the hinge 266. A first distal member 270 is coupled to the first proximal member 268 via a second hinge 272. Thus, the second hinge 272 facilitates angular adjustment and positioning on the first distal member 270 relative to the first proximal member 268. The second arm 264 includes a second proximal member 274, which is coupled to the single flange 260 via the hinge 266. A second distal member 276 is coupled to the second proximal member 274 via a third hinge 278. Thus, the third hinge 278 facilitates angular adjustment and positioning on the second distal member 276 relative to the second proximal member 274. The first arm 262 and the second arm 264 receive and secure the vertical member 114 therebetween.

Figure 2F:
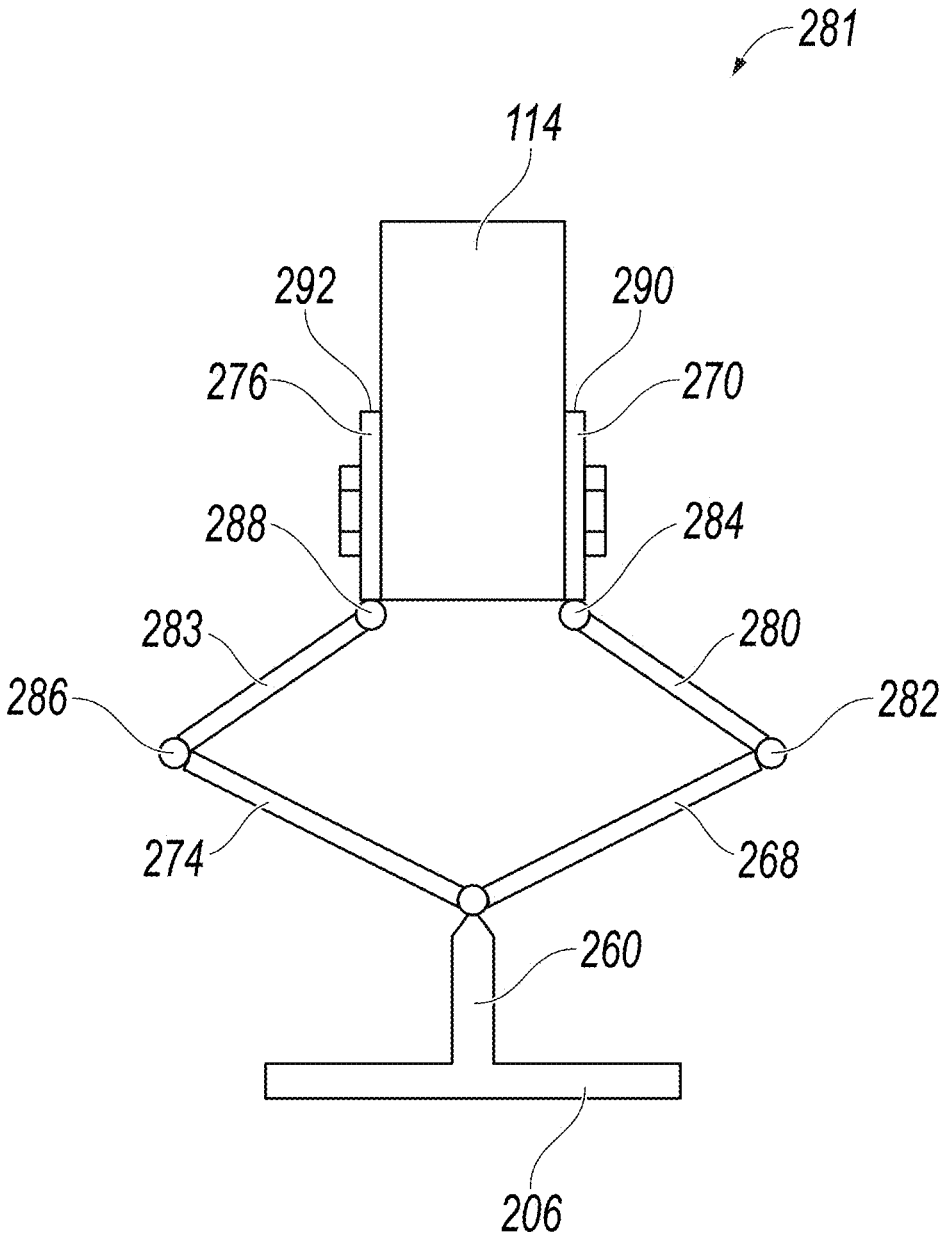
FIG. 2F is a top view of an exemplary curtain-wall anchor allowing for inward/outward adjustability.

FIG. 2F is a top view of a curtain-wall anchor 281, which allows for inward/outward adjustability. The single flange 260 extends from the back member 206 in an approximate center of the back member 206. A first arm 290 and a second arm 292 extend from the flange and, in various embodiments, may be coupled to the single flange 260 via the hinge 266. In such embodiments, the hinge 266 facilitates angular adjustment of the first arm 290 and the second arm 292 relative to each other and relative to the single flange 260 in an effort to accommodate vertical members of varying thicknesses. The first arm 290 includes the first proximal member 268, which is coupled to the single flange 260 via the hinge 266. A first central member 280 is coupled to the first proximal member 268 via a second hinge 282. A first distal member 270 is coupled to the first central member 280 via a third hinge 284. Thus, the second hinge 282 and the third hinge 284 facilitate inward and outward adjustment of the curtain-wall anchor 281 to accommodate an as-built location of the vertical member 114. The second arm 292 includes the second proximal member 274, which is coupled to the single flange 260 via the hinge 266. A second central member 283 is coupled to the second proximal member 274 via a fourth hinge 286. A second distal member 276 is coupled to the second central member 283 via a fifth hinge 288. Thus, the fourth hinge 286 and the fifth hinge 288 facilitate inward and outward adjustment of the curtain-wall anchor 281 to accommodate an as-built location of the vertical member 114.

FIG. 3A is a front plan view of the mounting bracket 104 showing the channel 106 attached thereto. During operation, a head portion of a first mounting bolt 302 and a second mounting bolt 304 are slidably inserted into the channel 106. The first mounting bolt 302 and the second mounting bolt 304 are received into the first slot 212 and the second slot 214, respectively. As illustrated in FIG. 3A, the shape of the first slot 212 and the shape of the second slot 214 facilitates positioning of the mounting bracket 104 in a select angular position and angular alignment of the mounting bracket 104 relative to the building structure 108 in instances where the channel 106 is attached to the building structure 108 in an out-of-level manner. In embodiments where the curtain-wall anchor is coupled to a top face of the building structure 108, the first slot 212 and the second slot 214 facilitate positioning of the curtain-wall anchor 100 in a select angular position and angular alignment of the mounting bracket 104 when the channel 106 is coupled to the building structure 108 in an out-of-square manner. A serrated or otherwise ridged surface 408 may be formed on a surface of the back member 206 opposite the building structure 108 in the region of the first slot 212 and/or the second slot 214.

In various embodiments, the ridged surface 408 is formed with vertically-oriented ridges. This orientation allows the ridged surface 408 to be, for example, extruded with the mounting bracket 104. In other embodiments, the ridged surface 408 may be formed with ridges oriented in any direction; however, an alignment axis 307 of the ridges of the ridged surface 408 should not be aligned parallel with an axis 309 of at least one of the first slot 212 and the second slot 214. Such misalignment of the axis 307 and the axis 309 increases frictional resistance to vertical movement of the back member 206 and thus ensures that the back member 206, once installed, remains in the desired position. A first lock washer 306 is positioned over the first mounting bolt 302 and a second lock washer 308 is positioned over the second mounting bolt 304. In various embodiments, the first lock washer 306 and the second lock washer 308 include a ridged surface that is complementary to, and mateably engages with, the ridged surface 408 of the back member 206 thereby increasing friction between the first lock washer 306 and the back member 206 and between the second lock washer 308 and the back member 206. Such an arrangement holds the mounting bracket 104 in the select position and prevents slippage of the mounting bracket 104 relative to the channel 106. In various embodiments, the first lock washer 306 is secured to the first mounting bolt 302 with a first nut 303 and the second lock washer 308 is secured to the second mounting bolt 304 with a second nut 305; however, in other embodiments, other securement devices could be utilized to secure the first lock washer 306 and the second lock washer 308. While the first lock washer 306 and the second lock washer 308 are discussed and illustrated herein by way of example, in various embodiments, at least one of the first lock washer 306 and the second lock washer 308 could be omitted or other lock washers and bolts could be added.

FIG. 3B is a front plan view of an exemplary mounting bracket 320 with a single arcuate slot 322 and showing a channel attached thereto. The mounting bracket 320 includes an arcuate slot 322 and a round aperture 324. In various embodiments, the arcuate slot 322 is similar to the first slot 212 discussed above. The arcuate slot 322 and the round aperture 324 facilitate attachment of the mounting bracket 320 to the channel 106. Further, the arcuate slot 322 allows pivoting of the mounting bracket 320 about the round aperture 324. Such pivoting allows positioning of the mounting bracket 320 in a select angular position relative to the building structure 108 when the channel 106 is attached to the building structure 108 in an out-of-level manner. By way of example, the round aperture 324 is shown in FIG. 3B as being positioned to the right of the arcuate slot 322 when the mounting bracket 320 is viewed from the front. In other embodiments, the round aperture 324 could be positioned, for example, to the left of the arcuate slot 322 when the mounting bracket 320 is viewed from the front.

Figure 3C:
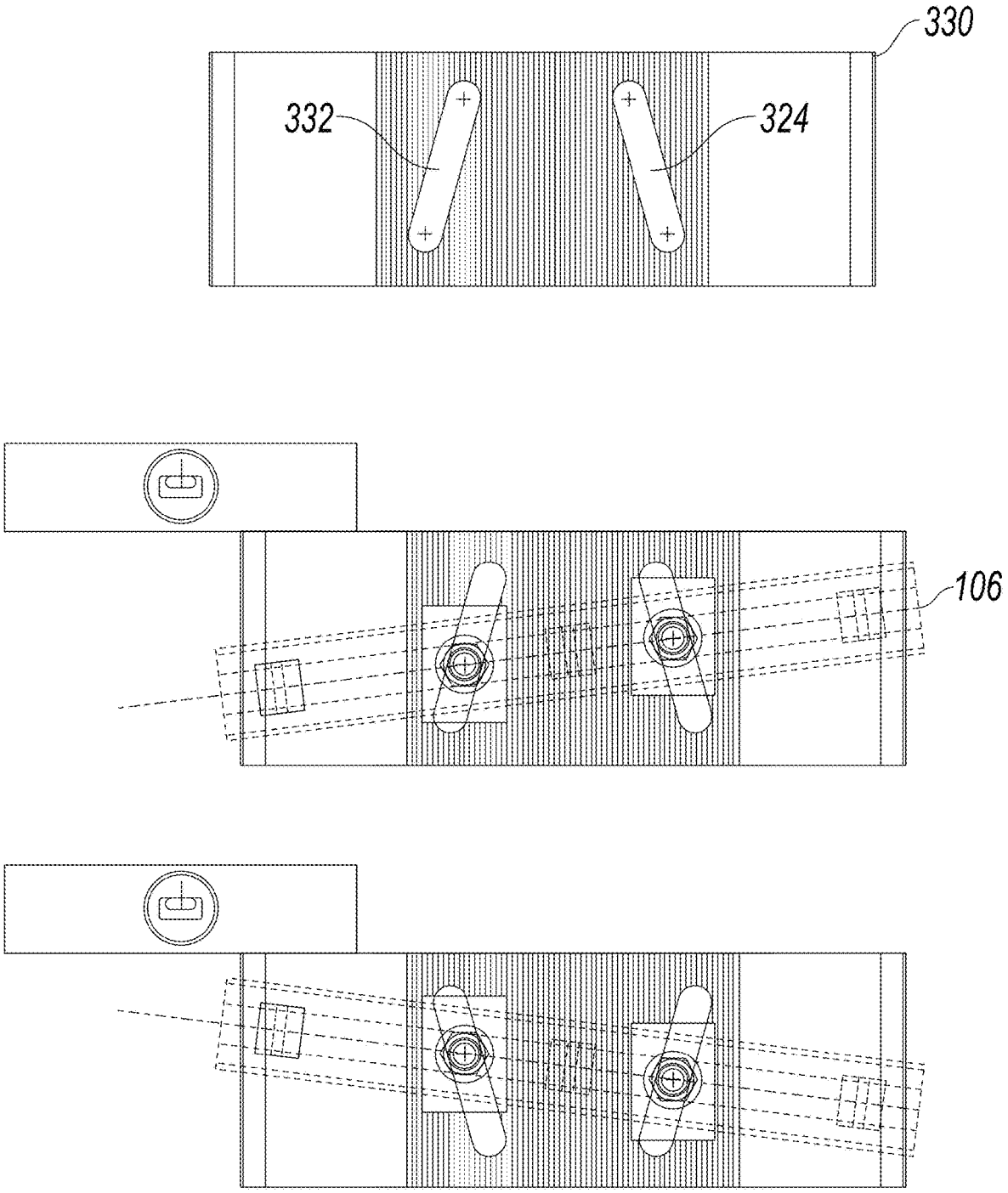
FIG. 3C is a front plan view of an exemplary mounting bracket with angled slots showing a rail attached thereto.

FIG. 3C is a front plan view of an exemplary mounting bracket 330 with angled slots and showing a channel 106 attached thereto. The mounting bracket 330 includes a first angled slot 332 and a second angled slot 334. In various embodiments, the first angled slot 332 and the second angled slot 334 are angled in opposite directions relative to a vertical axis such that the second angled slot 334 is an approximate mirror image of the first angled slot 332 about the vertical axis. However, the angled slots may be oriented in any direction toward one another that allows for adjustment of the mounting bracket 330. In the embodiment shown in FIG. 3C, the first angled slot 332 and the second angled slot 334 are inclined in the range of approximately 10 degrees to approximately 45 degrees relative to the vertical axis. The first angled slot 332 and the second angled slot 334 facilitate attachment of the mounting bracket 330 to the channel 106. Additionally, the first angled slot 332 and the second angled slot 334 allow angular adjustment of the mounting bracket 330 and positioning of the mounting bracket 330 in a select angular position when the channel 106 is attached to a side face of the building structure 108 in an out-of-level manner. Similarly, when configured for mounting to the top face of the building structure 108, slotted holes 1002 of the curtain-wall anchor 900 (discussed below) may be angled such as the first angled slot 332 and the second angled slot 334 of the curtain-wall anchor 100 to allow angular adjustment of the mounting plate 902 and positioning of the mounting plate 902 in a select angular position when the channel 916 is attached to the top face of the building structure 108 in an out-of-square manner.

Figure 3D:
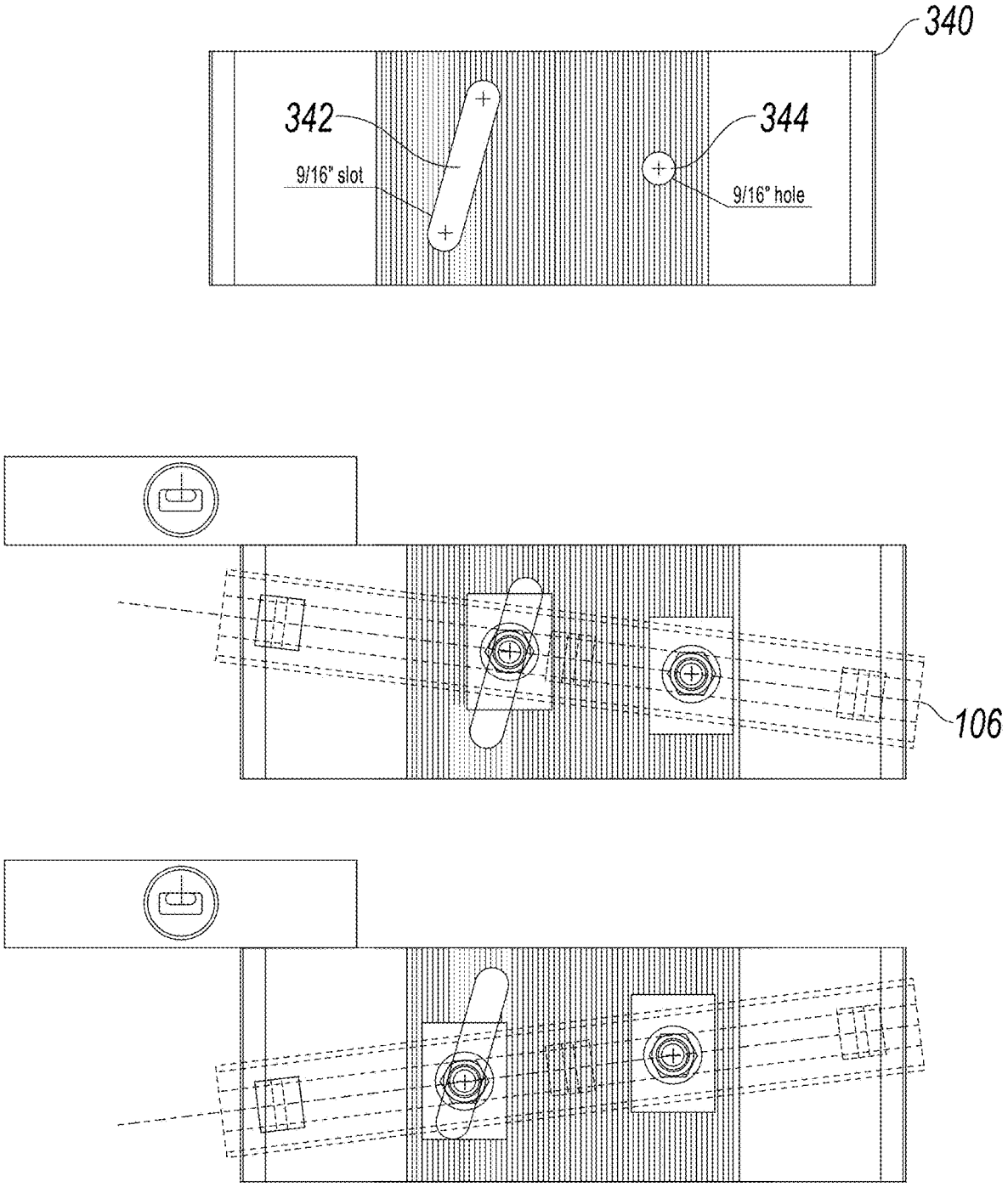
FIG. 3D is a front plan view of an exemplary mounting bracket with a single angled slot showing a rail attached thereto.

FIG. 3D is a front plan view of an exemplary mounting bracket 340 with a single angled slot 342 and showing a channel 106 attached thereto. The mounting bracket 340 includes the angled slot 342 and a round aperture 344. In various embodiments, the angled slot 342 is similar to the first angled slot 332 discussed above. The angled slot 342 and the aperture 344 facilitate attachment of the mounting bracket 340 to the channel 106. Further, the angled slot 342 allows pivoting of the mounting bracket 340 about the aperture 344. Such pivoting allows positioning of the mounting bracket 340 in a select angular position when the channel 106 is attached to the building structure 108 in an out-of-level manner. By way of example, the aperture 344 is shown in FIG. 3D as being positioned to the right of the angled slot 342 when the mounting bracket 340 is viewed from the front. In other embodiments, the aperture 344 could be positioned, for example, to the left of the angled slot 342 when the mounting bracket 340 is viewed from the front.

Figure 3E:
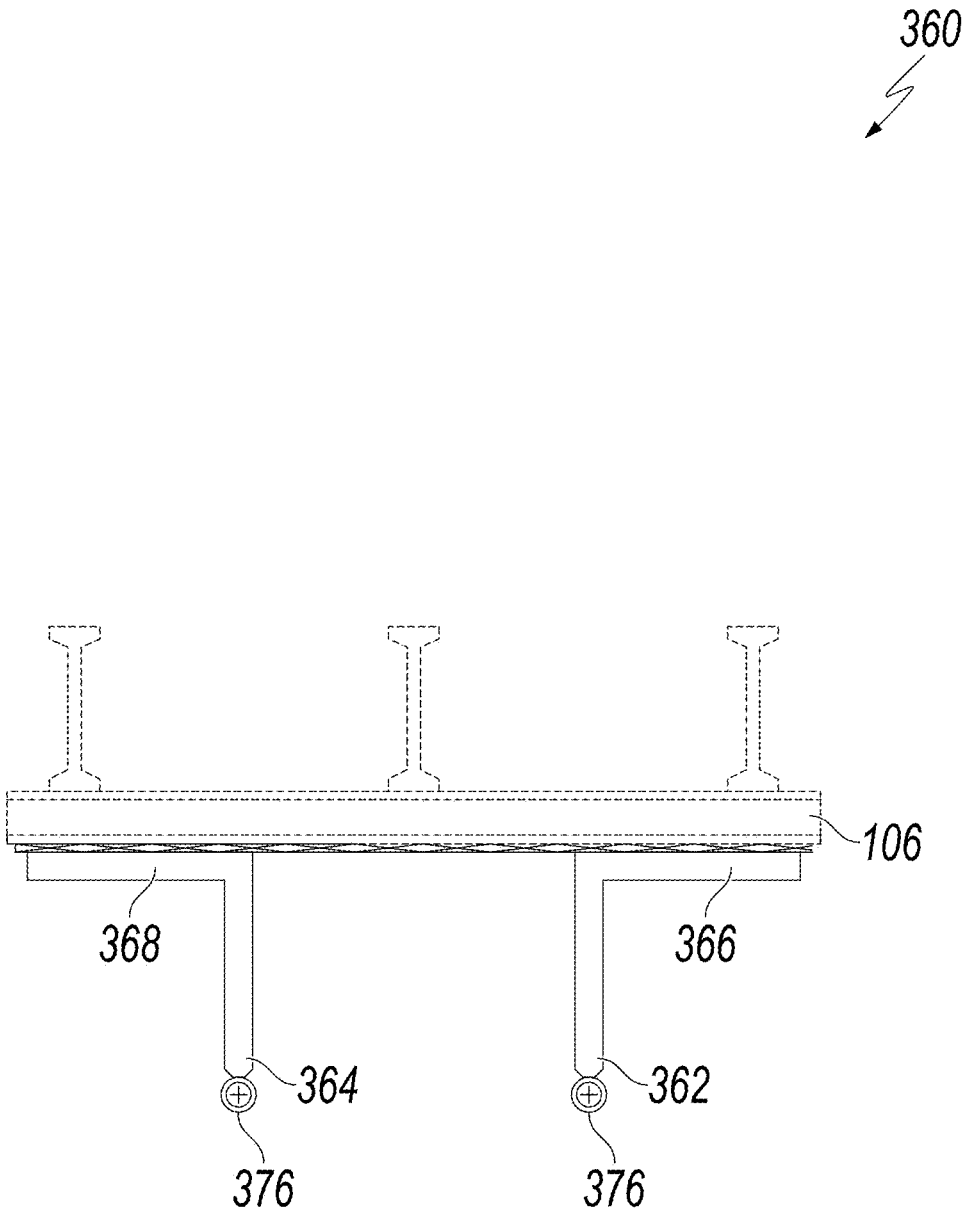
FIG. 3E is a top view of an exemplary curtain-wall anchor having independent flanges.

FIG. 3E is a top view of an exemplary curtain-wall anchor 360. The curtain-wall anchor 360 includes a first flange 362 and a second flange 364. The first flange 362 includes a first web 366 that abuts, and is coupled to, the channel 106. Likewise, the second flange 364 includes a second web 368 that abuts, and is coupled to, the channel 106. The first flange 362 includes a first attachment point 374 for a first arm and the second flange 364 includes a second attachment point 376 for a second arm. The first web 366 has a first hole 370 formed therein and the second web 368 has a second hole 372 formed therein. In various embodiments, the first hole 370 and the second hole 372 may be round, slotted, arcuate, or angular as shown in FIGS. 3A-3D in order to facilitate adjustment of at least one of the first flange 362 and the second flange 364 with the vertical member 114 in circumstances when the channel 106 is coupled to the building structure 108 in an out-of-level manner. In embodiments where the curtain-wall anchor 360 is coupled to a top face of the building structure 108, the first hole 370 and the second hole 372 facilitate positioning of the curtain-wall anchor 100 in a select angular position and angular alignment of the curtain-wall anchor 360 when the channel 106 is coupled to the building structure 108 in an out-of-square manner.

Figure 4:
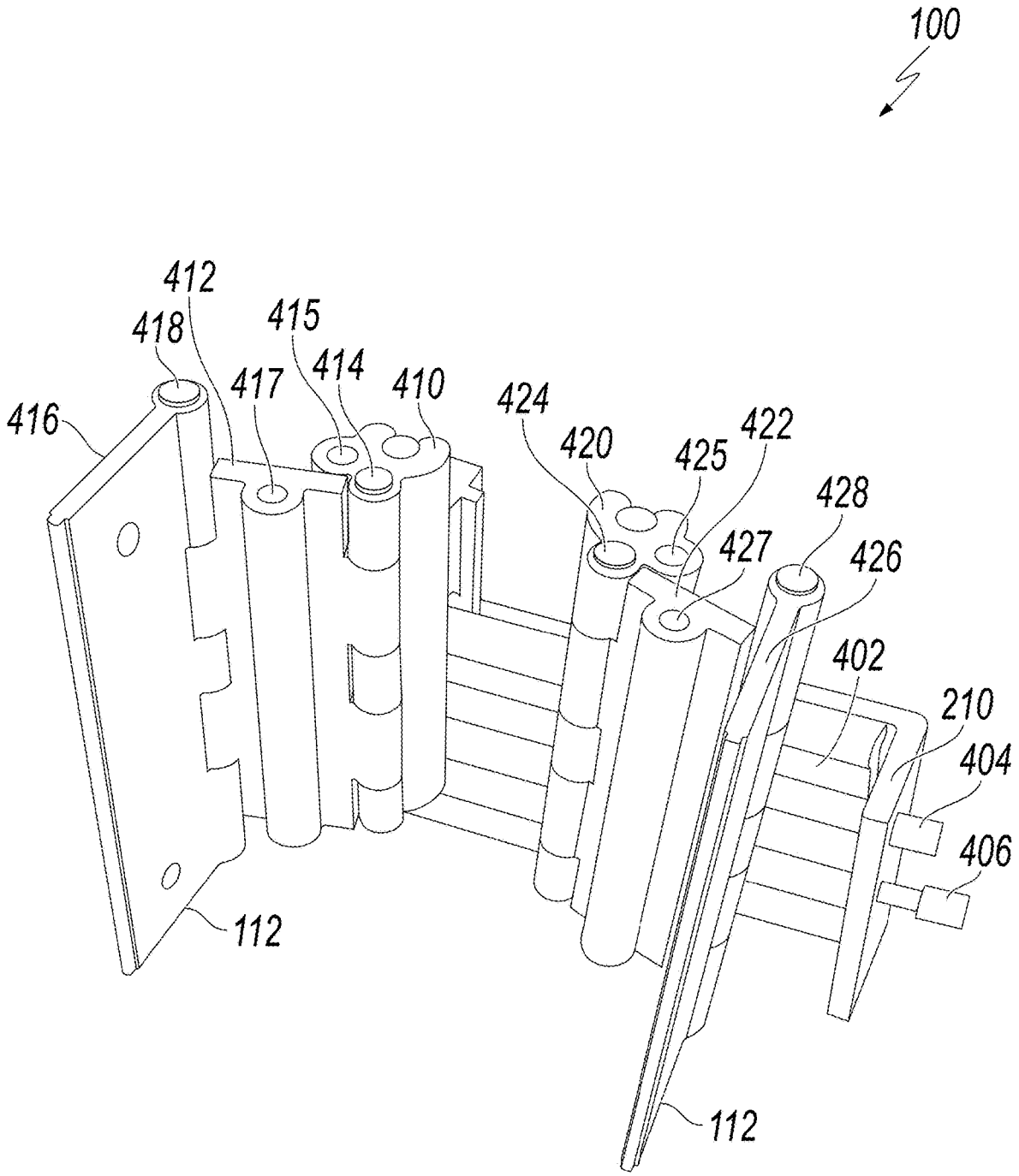
FIG. 4 is a top front perspective view of the curtain-wall anchor of FIG. 1 with the vertical member removed.

FIG. 4 is a top front perspective view of the curtain-wall anchor 100 with the vertical member removed. The front plate 402 is positioned between the first flange 208 and the second flange 210 of the mounting bracket 104. The front plate 402 is coupled to the first flange 208 and the second flange 210 via threaded fasteners 404 and 406; however, in other embodiments, any appropriate fastening mechanism such as, for example, screws, bolts, pins, rivets, welds, and the like may be utilized to couple the front plate 402 to the first flange 208 and the second flange 210. In various embodiments, the arm assembly 105 is coupled to the front plate. As illustrated herein, the arm assembly 105 may include the first arm 110 and the second arm 112; however, in other embodiments, the arm assembly 105 may include at least one of the first arm 110 and the second arm 112 and omit at least one of the first arm 110 and the second arm 112. The arm assembly 105 is slidably coupled to the front plate 402.

Still referring to FIG. 4, the first arm 110 includes a base member 410 that is hingedly coupled to an intermediate member 412 with a first pin 414 such that the intermediate member 412 is pivotable relative to the base member 410 about the first pin 414. A first locking hole 415 is formed on the base member 410 and a second locking hole 417 is formed on the intermediate member 412. The intermediate member 412 is hingedly coupled to a distal member 416 via a second pin 418 such that the distal member 416 is pivotable relative to the intermediate member 412 about the second pin 418. In similar fashion, the second arm 112 includes a base member 420 that is hingedly coupled to an intermediate member 422 with a third pin 424 such that the intermediate member 422 is pivotable relative to the base member 420 about the third pin 424. A first locking hole 425 is formed on the base member 420 and a second locking hole 427 is formed on the intermediate member 422. The intermediate member 422 is hingedly coupled to a distal member 426 via a fourth pin 428 such that the distal member 426 is pivotable relative to the intermediate member 422 about the fourth pin 428. Thus, the first arm 110 includes joints at the first pin 414 and the second pin 418, and the second arm 112 includes joints at the third pin 424 and the fourth pin 428, to accommodate varying clearances between the building structure 108 and the vertical member 114. FIG. 4 illustrates an embodiment where the first arm 110 and the second arm 112 include articulating, jointed members; however, in other embodiments, the first arm 110 and the second arm 112 may include straight, non-articulating members. In various embodiments, the first arm 110 and the second arm 112 facilitate adjustment of the curtain-wall anchor 100 relative to an as-built location of an edge of the building structure 108. Such adjustment allows a designated workpoint location of the curtain-wall system to be maintained.

Figure 5A:
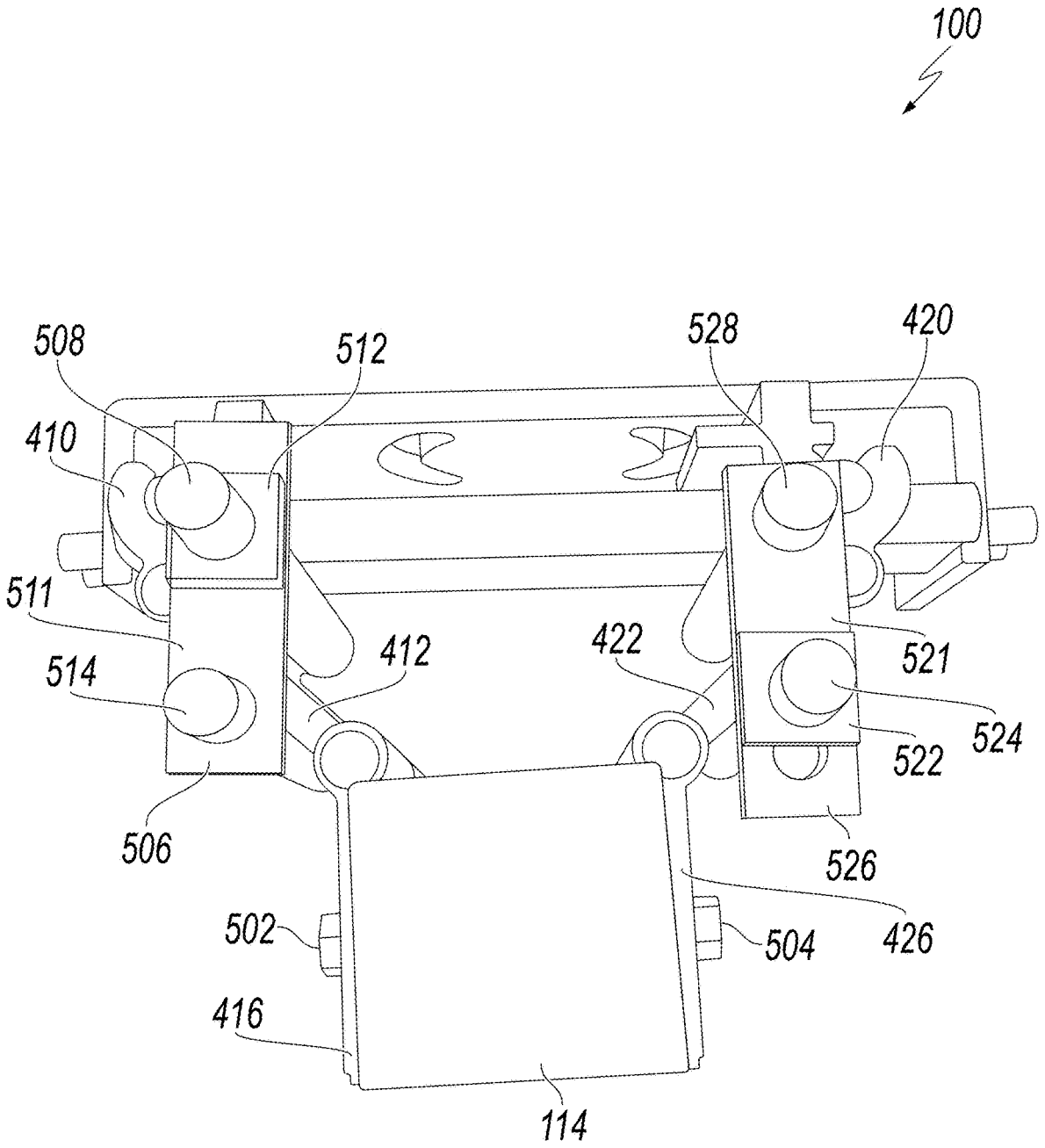
FIG. 5A is a front perspective view of the curtain-wall anchor of FIG. 1 showing the vertical member.
Figure 5B:
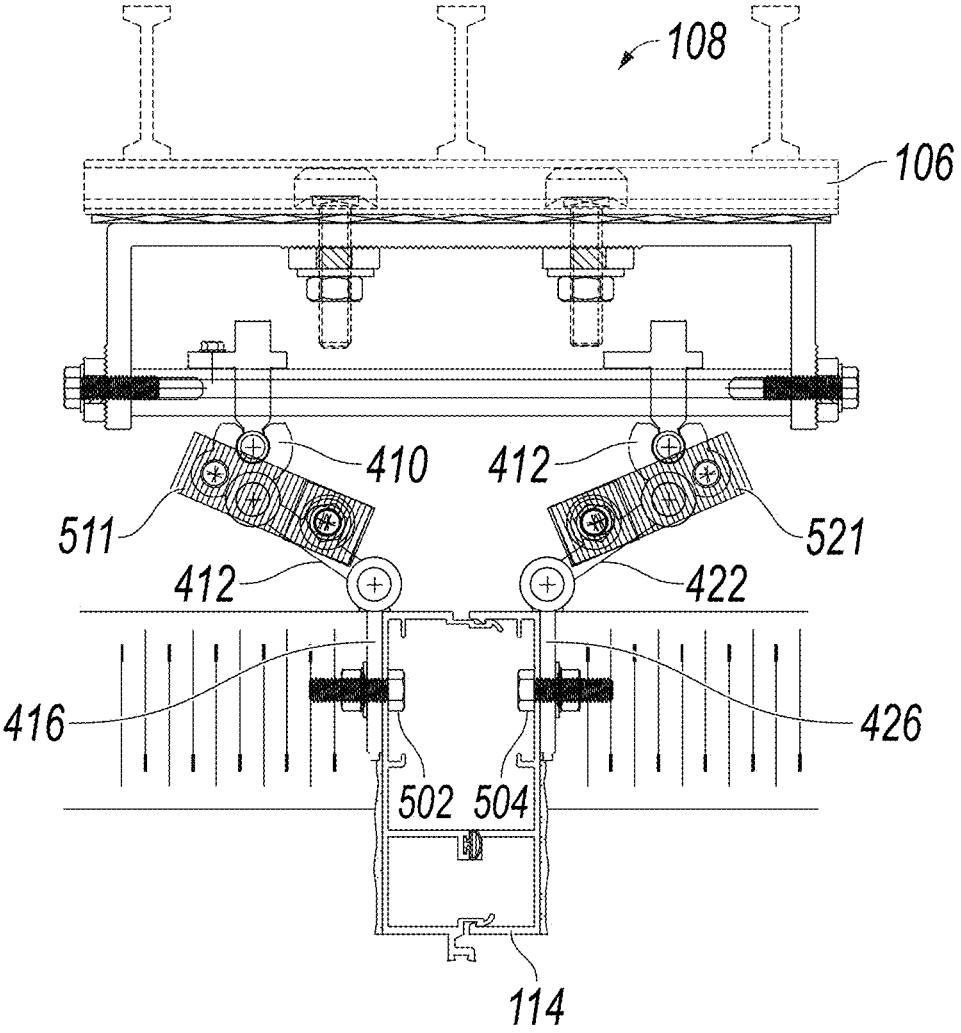
FIG. 5B is a top plan view of the curtain-wall anchor showing an exemplary attachment to the interior of a vertical member.

FIG. 5A is a front perspective view of the curtain-wall anchor 100 showing the vertical member 114. FIG. 5B is a top plan view of the curtain-wall anchor 100 showing attachment of the distal member 416 and the distal member 426 to an interior of the vertical member 114. The distal member 416 is coupled to the vertical member 114 with a first fastener 502 and the distal member 426 is coupled to the vertical member 114 with a second fastener 504. A first locking member 506 is positioned above the base member 410 and the intermediate member 412. A first locking pin 508 is inserted through the first locking member 506 and is received into the first locking hole 415. The first locking member 506 includes a ridged upper surface 511. A second locking member 512 is positioned above the first locking member 506. The second locking member 512 includes a ridged lower surface that is complementary to and that mateably engages with the ridged upper surface 511. A second locking pin 514 extends through the first locking member 506 and the second locking member 512 and is received into the second locking hole 417. The first locking member 506 and the second locking member 512 fix an angular position of the intermediate member 412 relative to the base member 410. As illustrated in FIG. 5B, in various embodiments, the distal member 416 and the distal member 426 may be coupled to an interior of the vertical member 114.

Figure 5C:
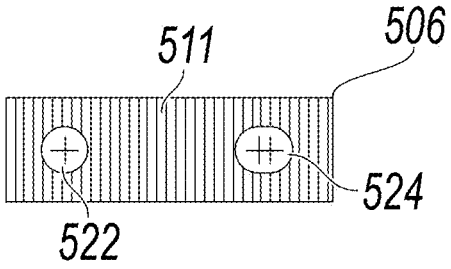
FIG. 5C is a top view of a locking member according to an exemplary embodiment.
Figure 5D:
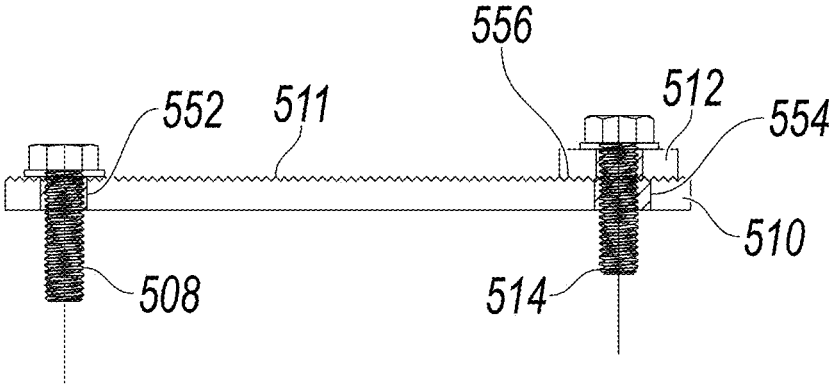
FIG. 5D is a side view of the locking member of FIG. 5C.

FIG. 5C is a top plan view of the first locking member 506. FIG. 5D is a side plan view of the first locking member 506 coupled to the second locking member 512. Referring to FIGS. 5C and 5D, the first locking member 506 includes the ridged upper surface 511. The first locking member 506 includes a first hole 552 and a second hole 554. The first hole 552 is approximately round while the second hole 554 is oblong having a major axis parallel to the long axis of the first locking member 506 or vice versa. The oblong shape of the second hole 554 facilitates placement of the first locking pin 508 or the second locking pin 514. As shown in FIG. 5D, the second locking member 512 includes the ridged lower surface 556 that mateably engages with the ridged upper surface 511 to fix the second locking member 512 in position relative to the first locking member 506.

Still referring to FIGS. 5A-5D, a third locking member 526 is positioned above the base member 420 and the intermediate member 422. A third locking pin 528 is inserted through the third locking member 526 and is received into the first locking hole 425. The third locking member 526 includes a ridged upper surface 521. A fourth locking member 522 is positioned above the third locking member 526. The fourth locking member 522 includes a ridged lower surface that mateably engages with the ridged upper surface 521. In various embodiments, the third locking member 526 and the fourth locking member are similar in construction and operation to the first locking member 506 and the second locking member 512. A fourth locking pin 524 extends through the third locking member 526 and the fourth locking member 522 and is received into the second locking hole 427. The third locking member 526 and the fourth locking member 522 fix an angular position of the intermediate member 422 relative to the base member 420.

Figure 6A:
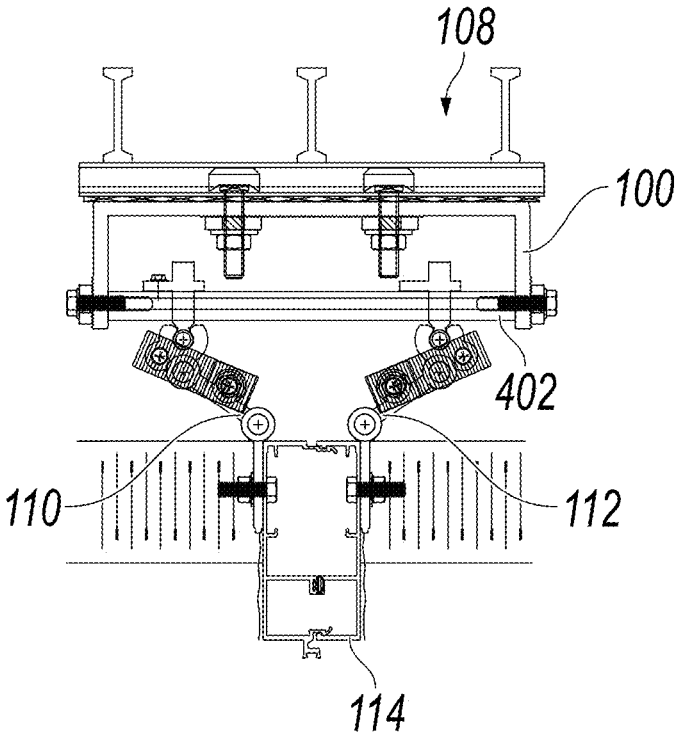
FIG. 6A is a top plan view of the curtain-wall anchor of FIG. 1 illustrating nominal placement of the building structure relative to the vertical member.
Figure 6B:
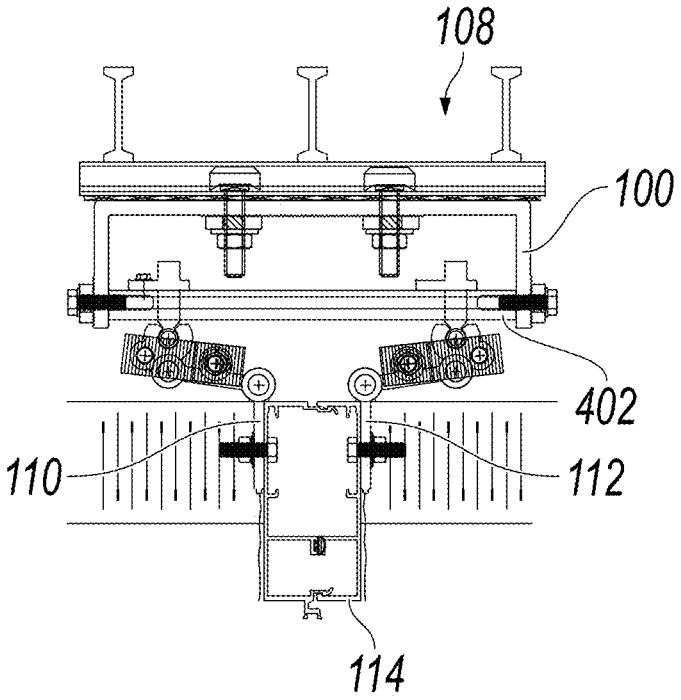
FIG. 6B is a top plan view of the curtain-wall anchor of FIG. 1 illustrating reduced clearance between the building structure and the vertical member.
Figure 6C:
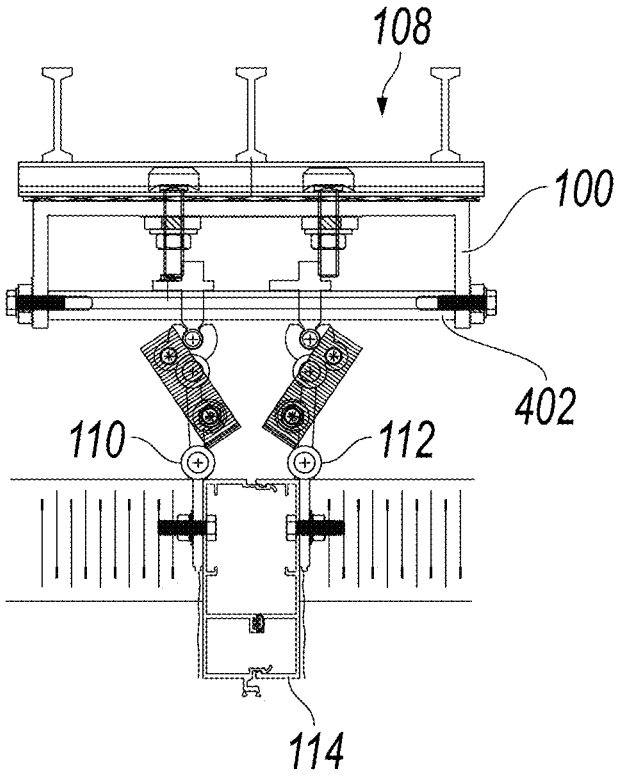
FIG. 6C is a top plan view of the curtain-wall anchor of FIG. 1 illustrating increased clearance between the building structure and the vertical member.

FIG. 6A is a top plan view of the curtain-wall anchor 100 illustrating nominal placement of the building structure 108 relative to the vertical member 114. FIG. 6B is a top plan view of the curtain-wall anchor 100 illustrating reduced clearance between the building structure 108 and the vertical member 114. FIG. 6C is a top plan view of the curtain-wall anchor 100 illustrating increased clearance between the building structure 108 and the vertical member 114. As illustrated in FIGS. 6A-6C, a lateral position of the first arm 110 and the second arm 112 relative to the front plate 402 is adjustable to accommodate varying clearances between or building structure 108 and the vertical member 114. Additionally, the first arm 110 is able to pivot about the first pin 414 and the second pin 418, and the second arm 112 is able to pivot about the third pin 424 and the fourth pin 428, to accommodate varying clearances between the building structure 108 and the vertical member 114.

Figure 7A:
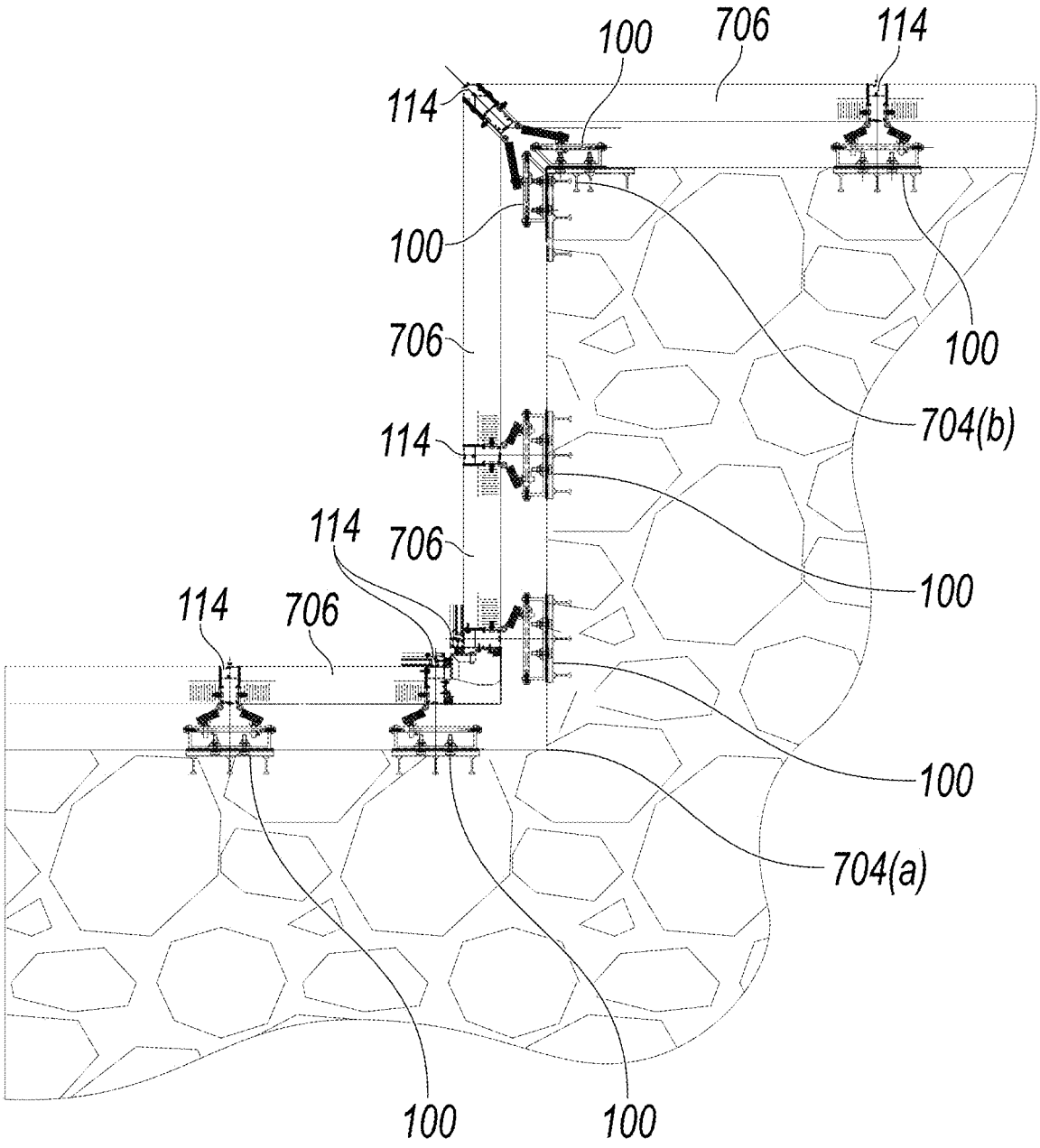
FIG. 7A is a plan view of an exemplary curtain-wall system illustrating a connection to a building structure.

FIG. 7A is a plan view of an exemplary curtain-wall system 700 illustrating a connection to a building structure 702. In various embodiments, the building structure 702 includes a plurality of corners 704. The curtain-wall system 700 includes a plurality of vertical member 114 and a plurality of panel members 706 disposed between adjacent vertical member 114. A plurality of curtain-wall anchors 100 secure the plurality of vertical member 114 to the building structure 702. As illustrated in FIG. 7, the curtain-wall anchors 100 may be modified to facilitate attachment of certain vertical member 114 that are in the vicinity of the corners 704.

Figure 7B:
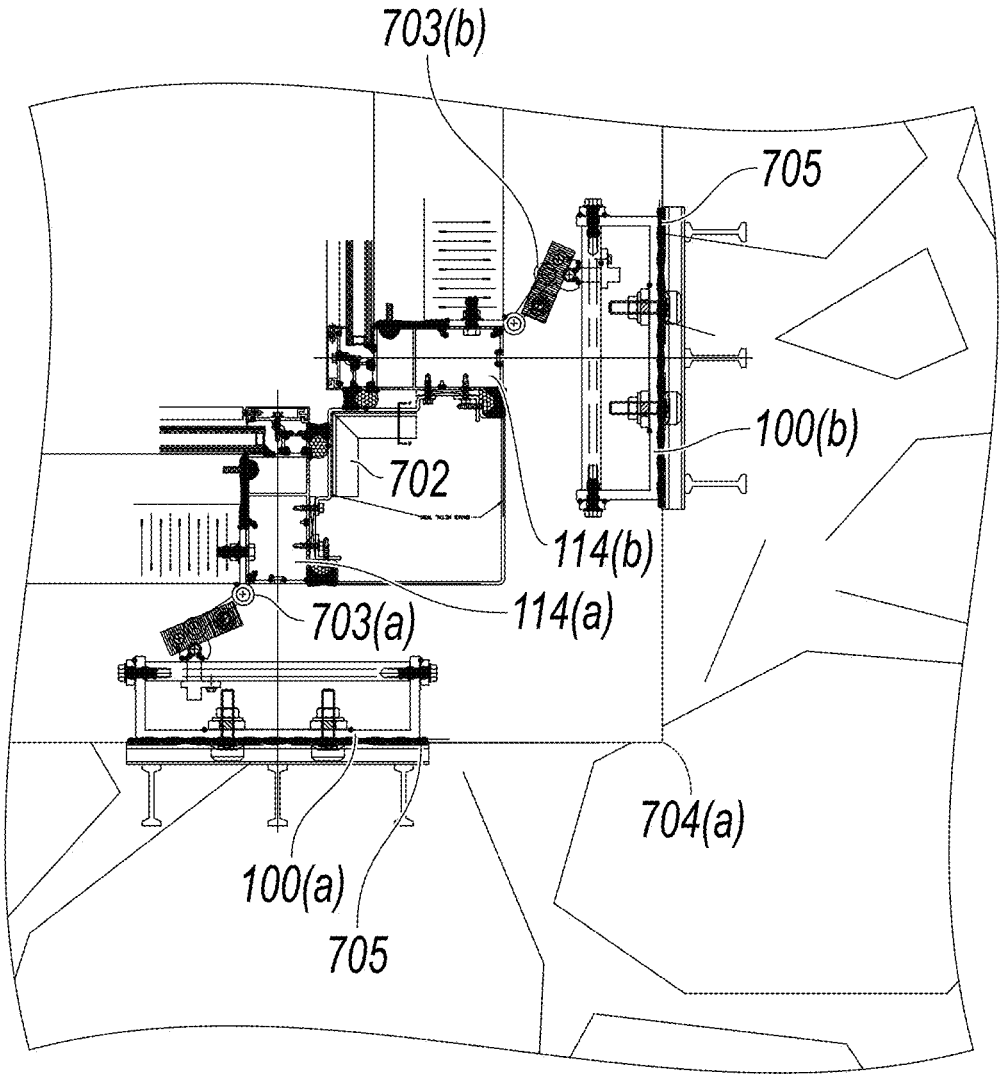
FIG. 7B is a detail view of an interior corner of the curtain-wall system of FIG. 7A.

FIG. 7B is a detail view of an interior corner 704(*a*) of the curtain-wall system 700. The interior corner 704(*a*), for example, may utilize two curtain-wall anchors 100(*a*) and 100(*b*) arranged on generally orthogonal wall panels. Each curtain-wall anchor 100(*a*) and 100(*b*) includes a single arm 703(*a*) and 703(*b*) coupled to an outside face of a respective vertical member 114(*a*) and 114(*b*). The inside face of the vertical member 114(*a*) is coupled to the inside face of the vertical member 114(*b*) with an angled trim strip 707. In other embodiments, the curtain-wall anchors 100(*a*) and 100(*b*) may each comprise two arms such that an arm is coupled to an inside face and an outside face of the vertical member 114(*a*) and 114(*b*). In various embodiments, an isolation layer 705 is positioned between the curtain-wall anchor 100 and the building structure 702. In such embodiments, the isolation layer 705 may be constructed of, for example, a high-impact, temperature resistant, water-resistant polymer. The isolation layer 705 impedes of electrolysis between the curtain-wall anchor 100 and the building structure 702, which can lead to decomposition of the curtain wall anchor 100(*a*) and 100(*b*).

Figure 7C:
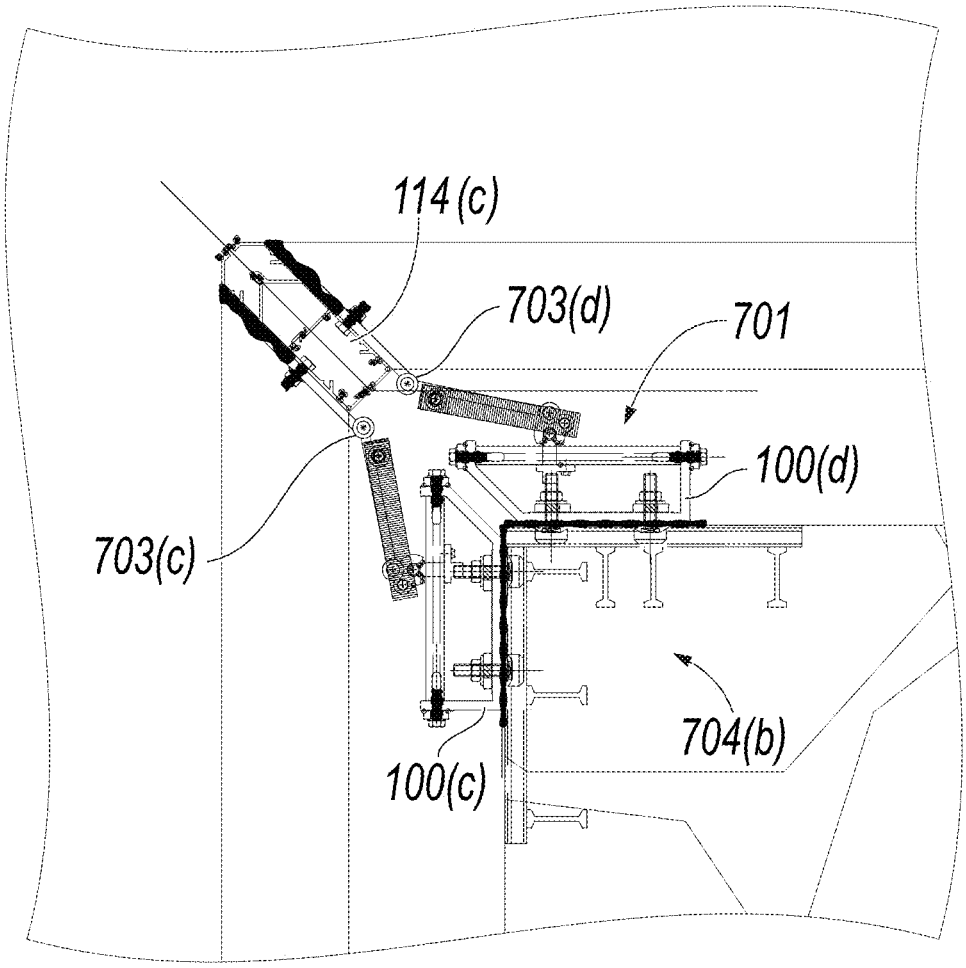

FIG. 7C is a detail view of an exterior corner 704(*b*) of the curtain-wall system 700. The exterior corner 704(*b*) utilizes, for example, a corner-anchor system 701. The corner-anchor system 701 may utilize two curtain-wall anchors 100(*c*) and 100(*d*) arranged on generally orthogonal wall panels. In other embodiments, the corner-anchor system 701 may include a single curtain-wall anchor that wraps around the exterior corner 704(*b*). The corner-anchor system 701 includes a first arm 703(*c*) and a second arm 703(*d*). The first arm 703(*c*) is coupled to an interior or exterior first face of the vertical member 114(*c*) and the second arm 703(*d*) is coupled to an interior or exterior second face of the vertical member 114(*c*). Where two curtain-wall anchors 100(*c*) and 100(*d*) are utilized, the curtain-wall anchor 100(*c*) includes the first arm 703(*c*) and the curtain-wall anchor 100(*d*) includes the second arm 703(*d*).

Figure 8A:
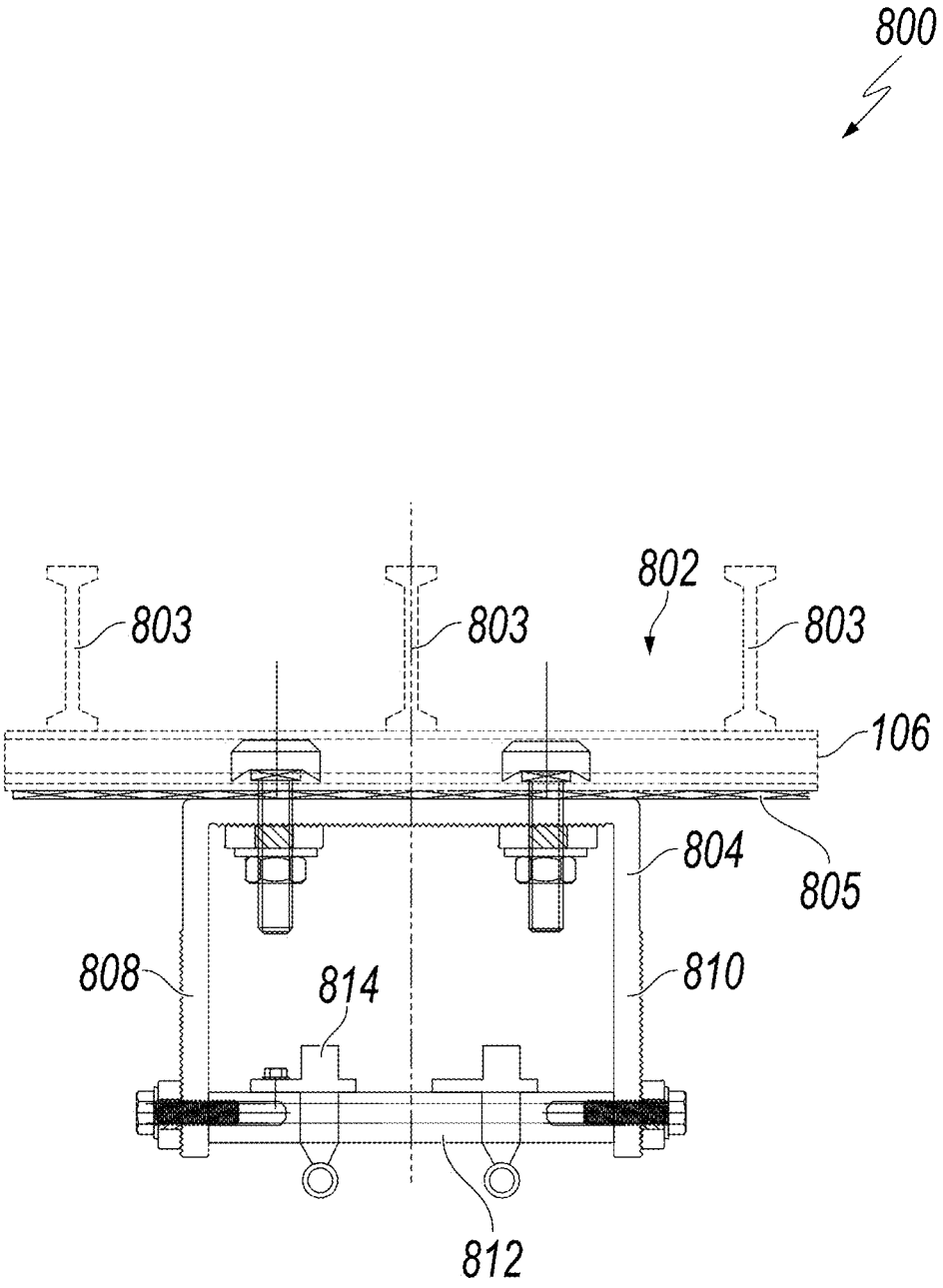
FIG. 8A is a plan view of an exemplary curtain-wall anchor.

FIG. 8A is a plan view of a curtain-wall anchor 800. The channel 106 is coupled to the building structure 802 with embedded anchors 803. The curtain-wall anchor 800 includes a mounting bracket 804 with a back member 806, a first flange 808 extending from the back member 806, and a second flange 810 extending from the back member 806. A front plate 812 is positioned between the first flange 808 and the second flange 810 of the mounting bracket 804. In various embodiments, slotted holes are formed in the first flange 808 and the second flange 810. The slotted holes extend in a direction generally orthogonal to the building structure 802 thereby allowing forward and rearward adjustment of the front plate 812 relative to the first flange 808 and the second flange 810. Such adjustability of the front plate 812 facilitates accommodation of varying clearances between the building structure 108 and the vertical member 114. The front plate 812 includes a first attachment 814 for a first arm (not shown) and a second attachment 816 for a second arm (not shown). A linear position of the first attachment 814 and the second attachment 816 along the front plate 812 may be adjusted. In various embodiments, the curtain-wall anchor 800 centers a load associated with the vertical member 114 over the embedded anchors 803 so as to avoid, for example, a prying moment being applied to the embedded anchors 803. In various embodiments, an isolation layer 805 is positioned between the curtain-wall anchor 800 and the building structure 802. In such embodiments, the isolation layer 805 may be constructed of, for example, a high-impact, temperature resistant, water-resistant polymer. The isolation layer 805 impedes of electrolysis between the curtain-wall anchor 800 and the building structure 802, which can lead to decomposition of the curtain wall anchor 800.

Figure 8B:
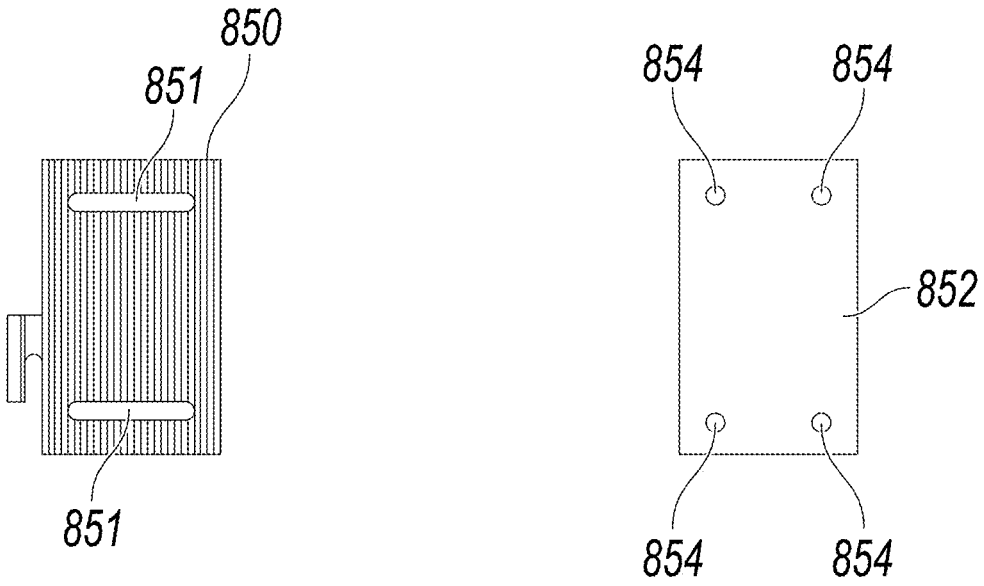
FIG. 8B is an exploded side view of an exemplary arm for use with the curtain-wall anchor of FIG. 8A.

FIG. 8B is an exploded side view of an arm 850 for use with the curtain-wall anchor 800. In various embodiments, the arm 850 may be the first arm or the second arm discussed above with respect to FIG. 8A. As shown in FIG. 8B, in various embodiments, the arm 850 may include slotted holes 851 formed in a direction generally orthogonal to the building structure 802. In one embodiment, the slotted holes 851 allow adjustable connection of the first arm and the second arm to the vertical member 114 and facilitate accommodation of varying clearances between the building structure 108 and the vertical member 114. In other embodiments, as shown in FIG. 8B, a secondary plate 852 may be utilized in conjunction with the arm 850. The secondary plate 852 includes a plurality of holes 854 formed therein. When assembled, at least two holes of the plurality of holes 854 align with the slotted holes 851 to facilitate attachment of the secondary plate 852 to the arm 850. Such an arrangement facilitates adjustment of the secondary plate 852 relative to the arm 850. The arm 850 is secured to the vertical member 114 via the remaining holes of the plurality of holes 854.

Figure 9:
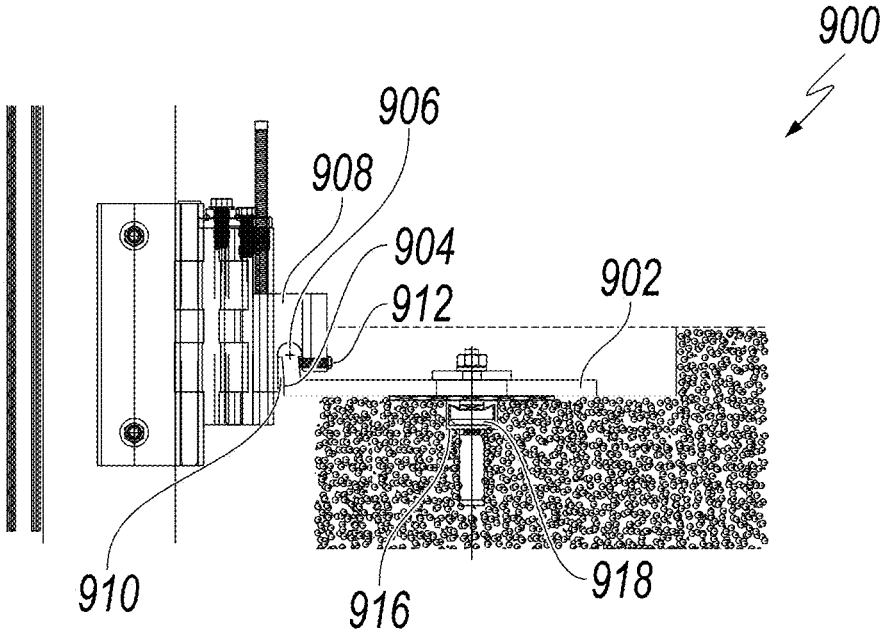
FIG. 9 is a side plan view of a curtain-wall anchor mounted in a top configuration.
Figure 10:
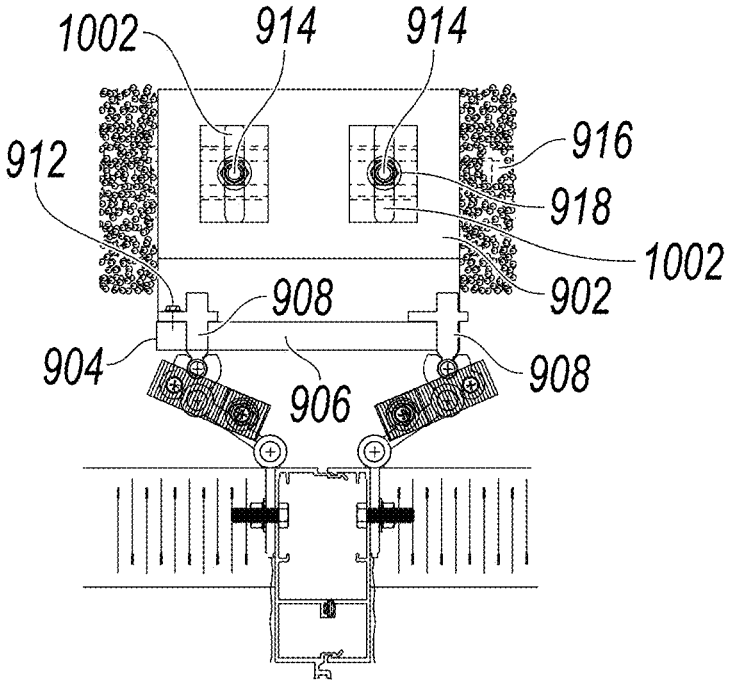
FIG. 10 is a top plan view of the curtain-wall anchor of FIG. 9.

FIG. 9 is a side plan view of a curtain-wall anchor 900 mounted to a top surface of the building structure 108. FIG. 10 is a top plan view of the curtain-wall anchor 900. The curtain-wall anchor 900 includes a mounting plate 902. The mounting plate 902 includes a flange 904. The flange 904 is turned upwardly from the mounting plate 902 in a direction opposite the building structure 108. The flange 904 includes a mounting surface 906. The curtain-wall anchor 900 includes a support member 908 coupled to the mounting plate 902. The support member 908 includes a recess 910. In operation, the recess 910 receives the mounting surface 906. A screw 912 is disposed in the support member 908 proximate the mounting surface 906. In operation, the screw, when extended, engages the flange 904 near the mounting surface 906 and prevents unintended linear or angular movement of the support member 908 relative to the mounting plate 902. In various embodiments, the support member 908 may include a first arm and a second arm similar to the first arm 110 and the second arm 112 discussed relative to FIG. 1; however, in other embodiments, any support member could be utilized. For example, the first arm 110 and the second arm 112 may, in various embodiments, include articulating, jointed members as illustrated, for example, in FIG. 4; however, in other embodiments, the first arm 110 and the second arm 112 may include straight, non-articulating members.

Still referring to FIGS. 9-10, the mounting plate 902 is coupled to the building structure 108 via, for example, anchors 914. In various embodiments, a channel 916 is embedded in, or otherwise attached to the building structure 108. The anchors 914 are received into the channel 916 such that a head region 918 of the anchors 914 is captured by the channel 916. In various embodiments, the mounting plate 902 has slotted holes 1002 formed therein to receive the anchors 914. The slotted holes 1002 facilitate forward and rearward adjustment of the mounting plate 902 as required. The mounting plate 902 is illustrated by way of example in FIGS. 9-10 as including the slotted holes 1002; however, one skilled in the art will recognize that, in various embodiments, the mounting plate may include round holes, angled slotted holes, arcuate slotted holes, or any combination thereof as illustrated, for example, in FIGS. 3A-3D.

Figure 11:
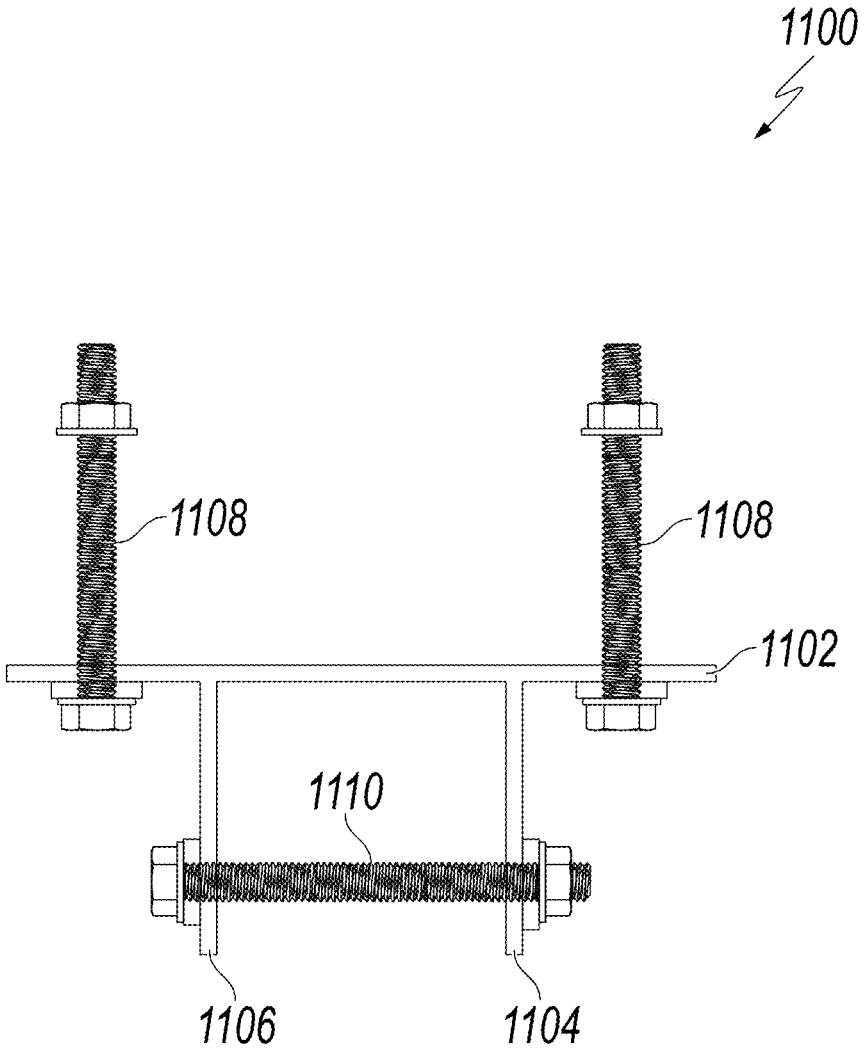
FIG. 11 is a top plan view of an exemplary curtain-wall anchor.

FIG. 11 is a top plan view of an exemplary curtain-wall anchor 1100. The curtain-wall anchor 1100 includes a base member 1102 that is arranged generally parallel to and abuts a structural member. In various embodiments, the structural member may be constructed of, for example, timber; however, in other embodiments, the structural member could be, for example, a composite slab constructed of, for example, concrete, or a metallic material such as, for example, steel of steel alloys. A first flange 1104 extends from the base member 1102 in a direction generally perpendicular to the base member 1102. A second flange 1106 extends from the base member 1102 in a direction generally perpendicular to the base member 1102. Anchor bolts 1108 are received through a first aperture 1202 and a second aperture 1204 formed through the base member 1102. The anchor bolts 1108 secure the curtain-wall anchor 1100 to the structural member. In various embodiments, an isolation layer such as, for example, the isolation layer 705 shown in FIG. 7B or the isolation layer 805 shown in FIG. 8A, is positioned between the curtain-wall anchor 1100 and the structural member. In such embodiments, the isolation layer may be constructed of, for example, a high-impact, temperature resistant, water-resistant polymer. The isolation layer impedes electrolysis between the curtain-wall anchor 1100 and the structural member, which can lead to decomposition of the curtain wall anchor 1100. A securement bolt 1110 extends through the first flange 1104 and the second flange 1106 and secures the vertical member to the first flange 1104 and the second flange 1106.

Figure 12A:
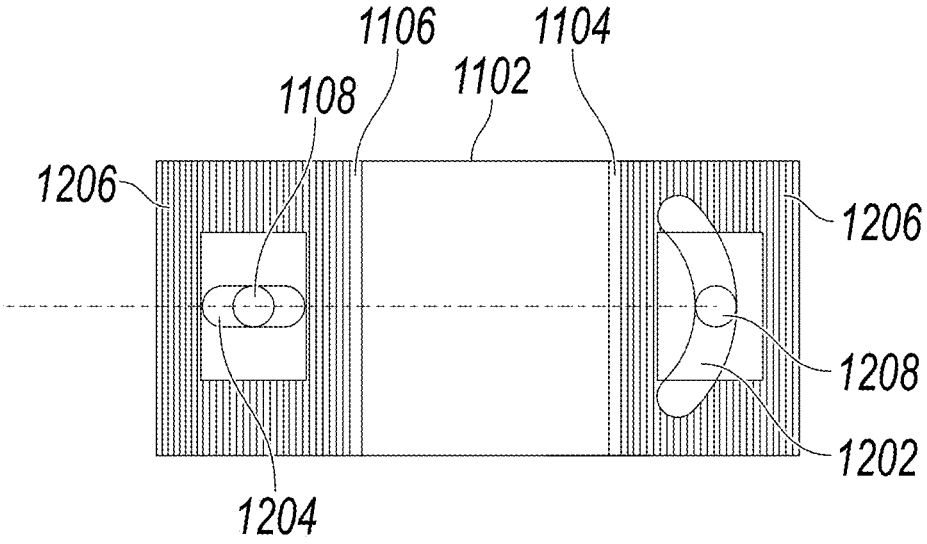
FIG. 12A is a front view of a base member of the curtain-wall anchor of FIG. 11.
Figure 12B:
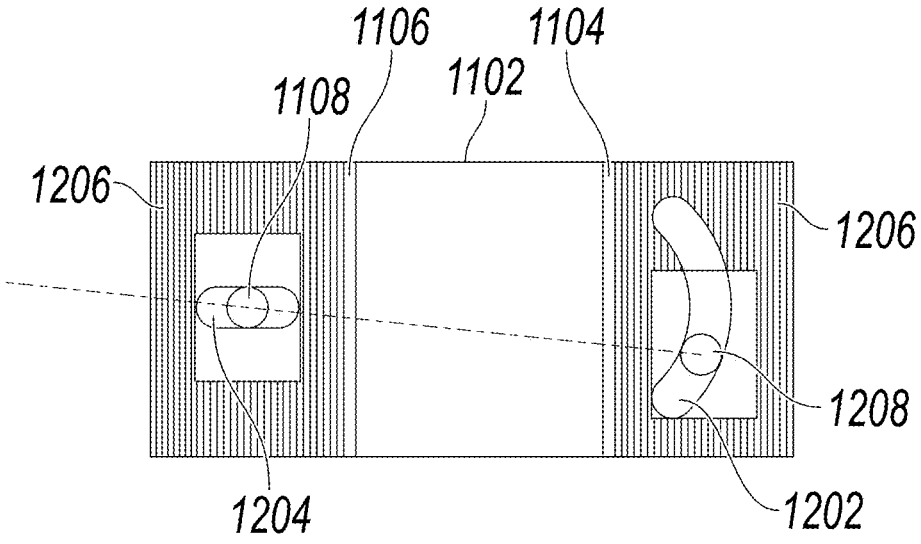
FIG. 12B is a front view of a base member of the curtain-wall anchor of FIG. 11 showing anchor bolts that are out of level.

FIG. 12A is a front view of a base member 1102 of the curtain-wall anchor 1100. FIG. 12B is a front view of a base member 1102 of the curtain-wall anchor 1100 showing anchor bolts 1108 that are out of level. Referring to FIGS. 12A and 12B together, the base member 1102 includes the first aperture 1202 and the second aperture 1204. The first aperture 1202 and the second aperture 1204 are illustrated by way of example in FIGS. 12A and 12B as being positioned outwardly of the first flange 1104 and the second flange 1106; however; the first aperture 1202 and the second aperture 1204 may be positioned at any location on the base member 1102 relative to the first flange 1104 and the second flange 1106. In various embodiments, the first aperture 1202 includes an arcuate slot and the second aperture 1204 includes a horizontal slot. In other embodiments, however, the first aperture 1202 could be a horizontal slot and the second aperture 1204 could be an arcuate slot. In various embodiments, as illustrated in FIG. 12B, the arcuate slot of the first aperture 1202 combined with the horizontal slot of the second aperture 1204 facilitate angular adjustment and angular positioning of the base member 1102 in a select angular position in the event that the anchor bolts 1108 are positioned out of level. By way of example, the curtain-wall anchor 1100 is illustrated as including the first aperture 1202 that is an arcuate slot and the second aperture 1204 as a horizontal slot. In various embodiments, however, the first aperture 1202 and the second aperture 1204 may be any shape including, for example, round, a linear horizontal slot, a linear vertical slot, a linear angled slot, an arcuate slot, or any combination thereof including the configurations specifically shown in FIGS. 3A-3D and discussed hereinabove relative thereto. Vertically-oriented ridges 1206 are formed on the surface of the base member 1102 in the location of the first aperture 1202 and the second aperture 1204. In various embodiments, the vertically-oriented ridges 1206 are vertically oriented and are generally perpendicular to a long axis of the base member 1102.

Figure 13:
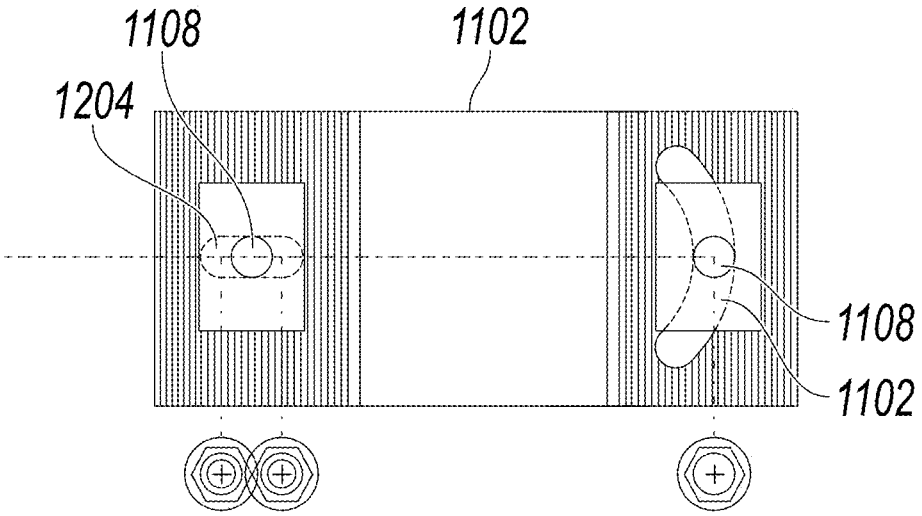
FIG. 13 is a front view of the base member illustrating variations in bolt width location.
Figure 14:
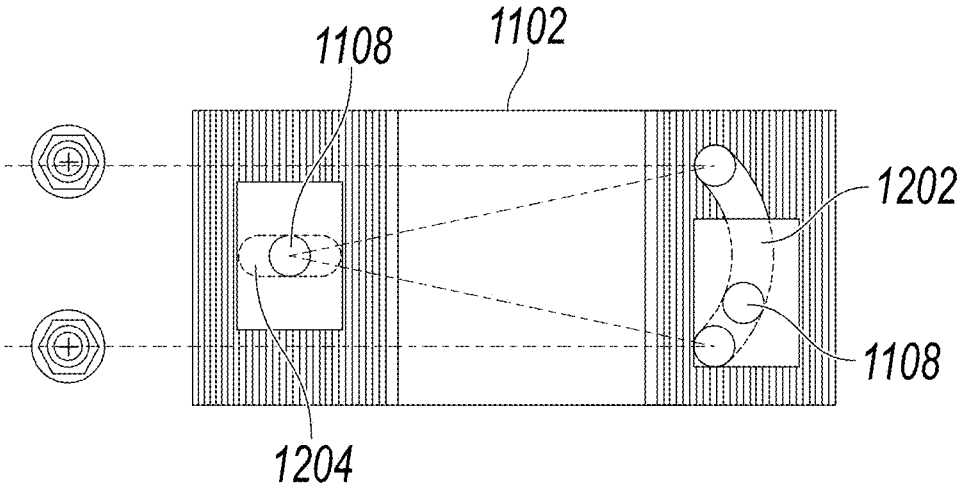
FIG. 14 is a front view of the base member illustrating variations in bolt angular location.

FIG. 13 is a front view of the base member 1102 illustrating variations in width between the anchor bolts 1108. FIG. 14 is a front view of the base member 1102 illustrating variations in angular location of the anchor bolts 1108. Referring to FIGS. 13-14 collectively, the horizontal slot of the second aperture 1204 allows the base member 1102 to accommodate variations in the width of the anchor bolts 1108. Similarly, the arcuate shape of the first aperture 1202 allows the base member 1102 to be placed in a select angular position in an effort to accommodate angular variations in the placement of the anchor bolts 1108. Additionally, the shape of the first aperture 1202 and the second aperture 1204 will not facilitate vertical movement of the base member 1102 relative to the anchor bolts 1108 without corresponding horizontal movement of the base member 1102 relative to the anchor bolts 1108.

Figure 15:
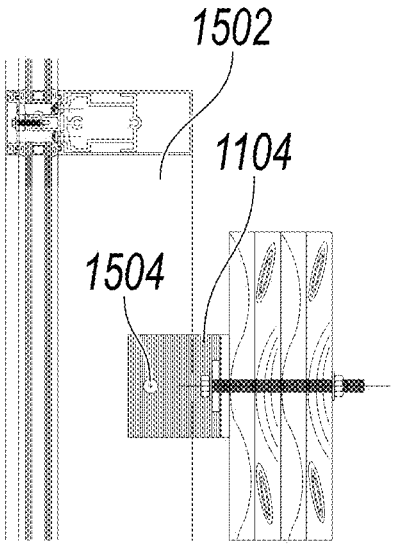
FIG. 15 is a side view of the curtain-wall anchor of FIG. 11 illustrating a first method of securement to a vertical member in a mass timber application.
Figure 16:
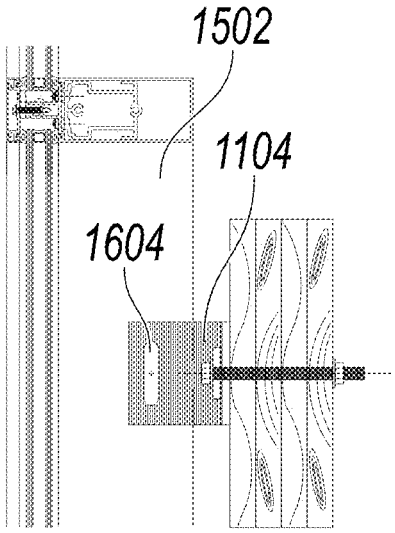
FIG. 16 is a side view of the curtain-wall anchor of FIG. 11 illustrating a second method of securement to a vertical member in a mass timber application.
Figure 17:
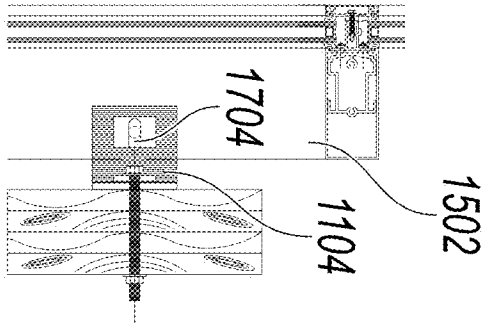
FIG. 17 is a side view of the curtain-wall anchor of FIG. 11 illustrating a third method of securement to a vertical member in a mass timber application.

FIG. 15 is a side view of the curtain-wall anchor 1100 illustrating a first method of securement to a vertical member 1502. A round aperture 1504 is formed though the first flange 1104 and the second flange 1106. In various embodiments, the round aperture 1504 allows the curtain-wall anchor 1100 to support the weight of a curtain-wall system. FIG. 16 is a side view of the curtain-wall anchor 1100 illustrating a second method of securement to the vertical member 1502. A vertically-slotted aperture 1604 is formed through the first flange 1104 and the second flange 1106. In various embodiments, the vertically-slotted aperture 1604 allows the curtain-wall anchor to support wind loading by a curtain-wall system. Additionally, the vertically-slotted aperture allows for vertical deflection of a structural member such as, for example, a building floor. FIG. 17 is a side view of the curtain-wall anchor 1100 illustrating a third method of securement to a vertical member 1502. A horizontally slotted aperture 1704 is formed through the first flange 1104 and the second flange 1106. In various embodiments, the horizontally-slotted aperture 1704 allows the curtain-wall anchor 1100 to support a weight of the curtain wall system and allows horizontal adjustment of the vertical member 1502 relative to the curtain-wall anchor 1100.

Figure 18:
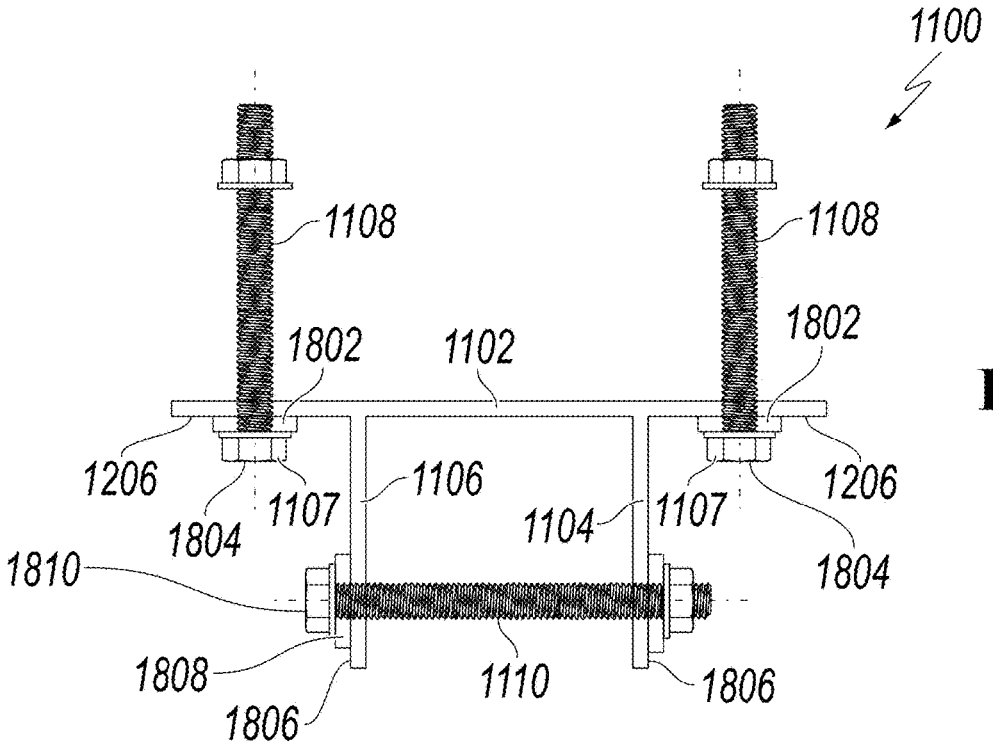
FIG. 18 is a plan view of a curtain-wall anchor showing placement of vertically-oriented ridges.

FIG. 18 is a plan view of a curtain-wall anchor 1100 showing placement of the vertically-oriented ridges 1206. In various embodiments, the vertically-oriented ridges 1206 are placed on the base member 1102 outwardly of the first flange 1104 and the second flange 1106 in the area of the base member 1102 surrounding the first aperture 1202 and the second aperture 1204. When assembled, the anchor bolts 1108 are received through the first aperture 1202 and the second aperture 1204. Locking washers 1802 are positioned around the anchor bolts 1108 between the base member 1102 and a head region 1804 of the anchor bolts 1108. The locking washers 1802 have vertically-oriented ridges formed on a face that abuts the base member 1102. The vertically-oriented ridges of the locking washers 1802 are complementary to, and engage with the vertically-oriented ridges 1206 formed on the base member 1102 and prevent horizontal movement of the base member 1102 relative to the anchor bolts 1108. In various embodiments, the locking washers 1802 are secured to the anchor bolts 1108 with nuts 1107; however, in other embodiments, other securement devices could be utilized to secure the locking washers 1802.

Still referring to FIG. 18, during operation, a downward vertical force is applied to the curtain-wall anchor 1100. The arcuate shape of the first aperture 1202, coupled with the horizontal slot of the second aperture 1204 causes downward movement of the base member 1102, relative to the anchor bolts 1108, require corresponding horizontal movement of the base member 1102. Engagement of the vertically-oriented ridges 1206 with the locking washers 1802 prevent horizontal movement of the base member 1102 and, thus, prevents vertical movement of the base member 1102 due to loading.

Figure 19:
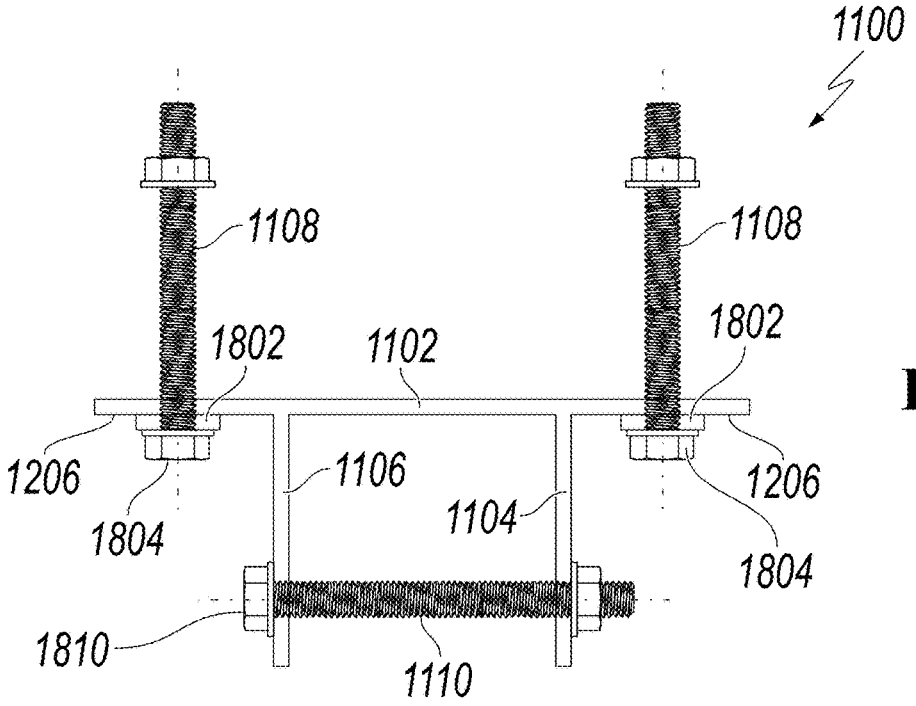
FIG. 19 is a plan view of the curtain-wall anchor of FIG. 18 showing an alternative placement of vertically-oriented ridges.

Still referring to FIG. 18, vertically-oriented ridges 1806 may be formed on the outwardly-facing sides of the first flange 1104 and the second flange 1106. A locking washer 1808 may be positioned between at least one of the first flange 1104 and the second flange 1106 and the head region 1810 of the securement bolt 1110. The locking washer 1808 engages the vertically-oriented ridges 1806 and prevents horizontal movement of the securement bolt 1110 relative to the first flange 1104 and the second flange 1106. FIG. 19 is a plan view of the curtain-wall anchor 1100 illustrating that, in various embodiments, the vertically-oriented ridges 1806 may be omitted from one or both of the first flange 1104 and the second flange 1106.

Figure 20A:
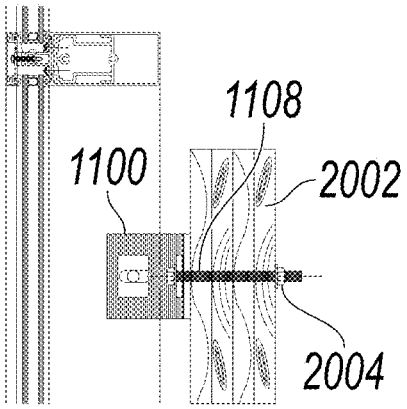
FIGS. 20A-20C are side views illustrating securement of the curtain-wall anchor to a mass timber structural member.
Figure 20B:
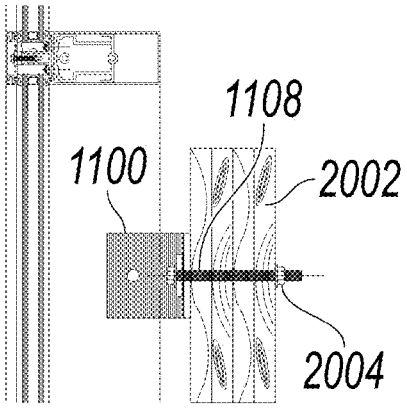
Figure 20C:
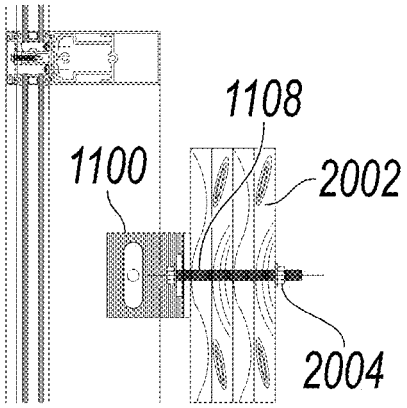
Figure 21A:
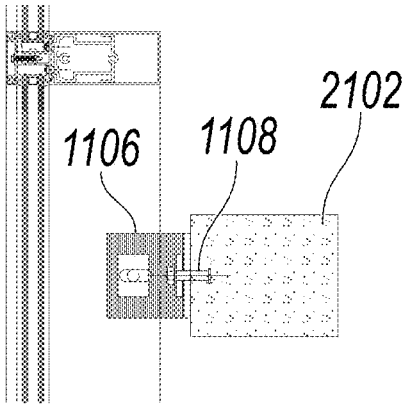
FIGS. 21A-21C are side views illustrating securement of the curtain wall anchor to a composite slab.
Figure 21B:
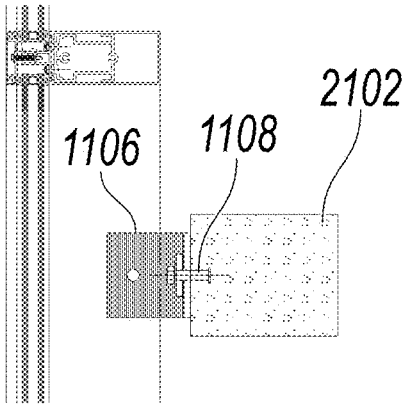
Figure 21C:
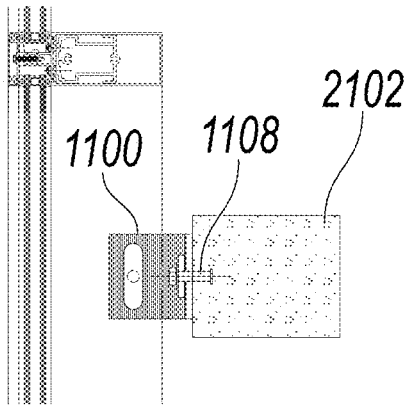
Figure 22A:
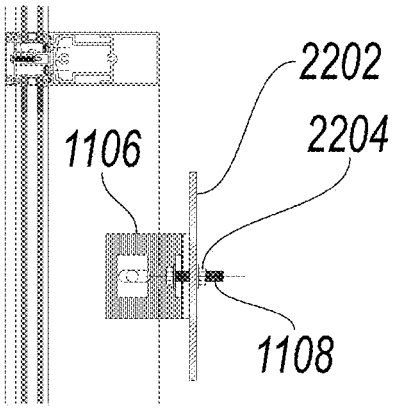
FIGS. 22A-22C are side views illustrating securement of the curtain-wall anchor to a metallic frame structural member.
Figure 22B:
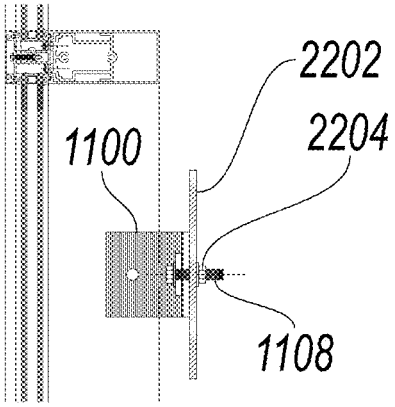
Figure 22C:
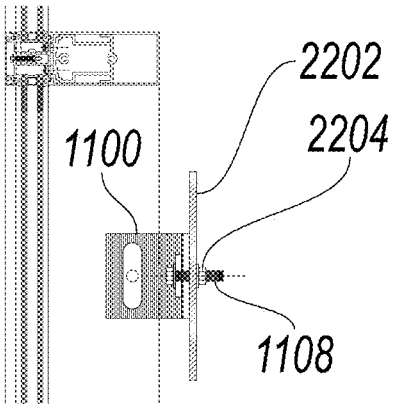

FIGS. 20A-20C are side views illustrating securement of the curtain-wall anchor 1100 to a timber structural member 2002. During operation, the anchor bolts 1108 extend through the timber structural member 2002 and are secured with a nut 2004. During operation, use of the nut 2004 prevents disengagement of the anchor bolts 1108 from the timber structural member 2002. In various other embodiments, the curtain-wall anchor 1100 may be secured to the structural member 2002 with, for example, a lag bolt. In such embodiments, the nut 2004 may be omitted. FIGS. 21A-21C are side views illustrating securement of the curtain wall anchor 1100 to a composite slab 2102. During operation, in various embodiments, the anchor bolts 1108 may be, for example, wedge anchors or other embedded anchors. FIGS. 22A-22C are side views illustrating securement of the curtain-wall anchor 1100 to a metallic structural member 2202. During operation, the anchor bolts 1108 extend through the metallic structural member 2202 and are secured with a nut 2204. During operation, use of the nut 2204 prevents disengagement of the anchor bolts 1108 from the metallic structural member 2202.

Figure 23:
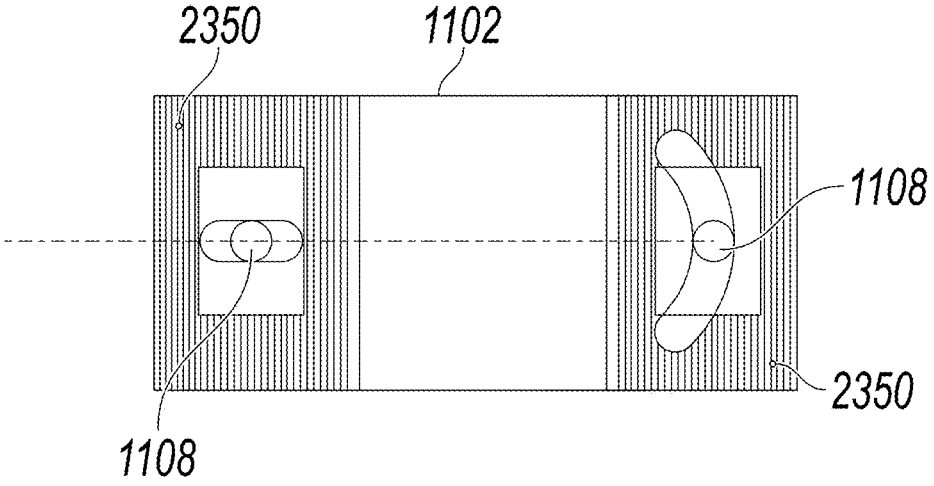
FIG. 23 is a front view of the base member of the curtain-wall anchor of FIG. 11 illustrating pilot holes.

FIG. 23 is a front view of the base member 1102 illustrating pilot holes 2350. In various embodiments, the curtain-wall anchor 1100 may include one or more pilot holes 2350 formed through the base member 1102. In various embodiments, the pilot holes 2350 facilitate temporary securement of the curtain-wall anchor 1100 to the structural member via, for example, nails or screws, before placement of the anchor bolts 1108. Such temporary securement of the curtain-wall anchor 1100 allows the curtain-wall anchor 1100 to be utilized as a template for drilling holes for placement of the anchor bolts 1108. In various embodiments, the pilot holes 2350 are formed, for example, in opposite corners of the base member 1102; however, in other embodiments, the pilot holes 2350 could be located at any position on the base member 1102.

Figure 24:
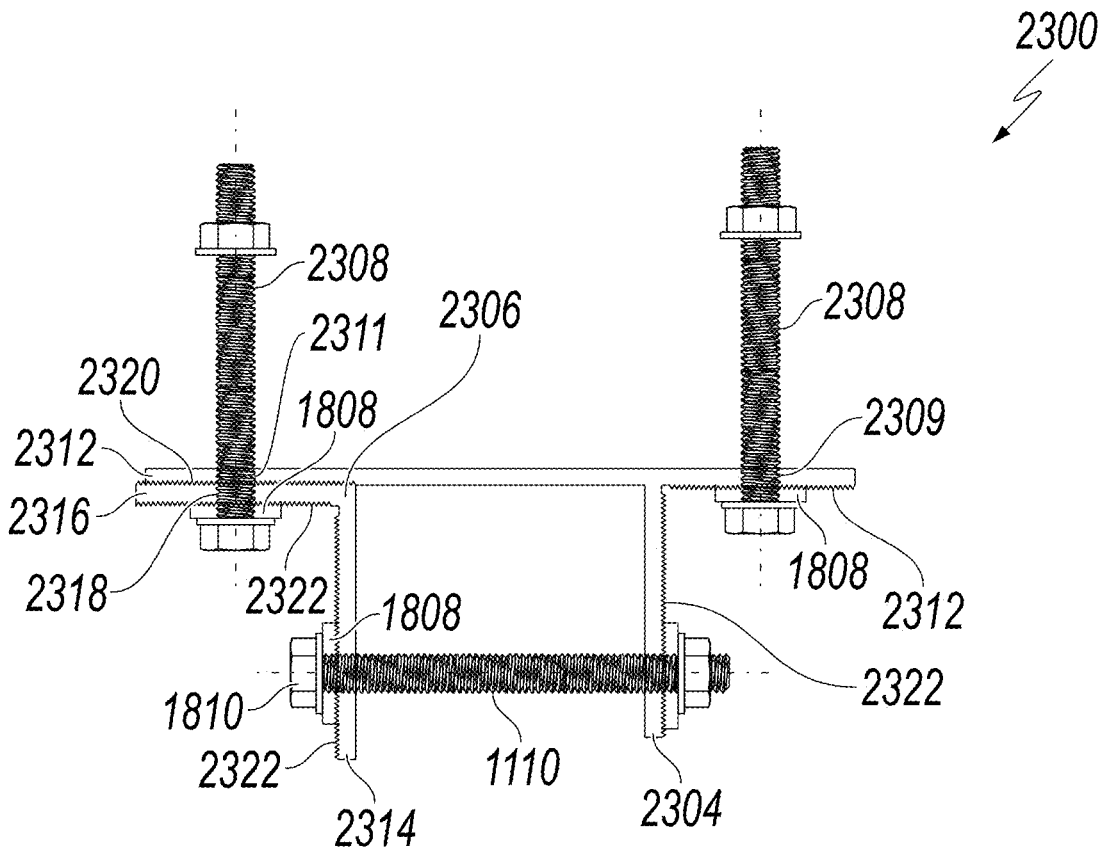
FIG. 24 is a top plan view of a curtain-wall anchor having an adjustable flange.

FIG. 24 is a top plan view of a curtain-wall anchor 2300 having an adjustment member 2306. The curtain-wall anchor 2300 includes a base member 2302 that is arranged generally parallel to and abuts a structural member. In various embodiments, the structural member may be constructed of, for example, timber; however, in other embodiments, the structural member could be, for example, a composite slab constructed of, for example, concrete or a metallic floor structure constructed of, for example, steel or steel alloys. A first flange 2304 extends from the base member 2302 in a direction generally perpendicular to the base member 2302. Anchor bolts 2308 are received through a first aperture 2309 and a second aperture 2311 formed through the base member 2302 and secure the curtain-wall anchor 2300 to the structural member. In various embodiments, the first aperture 2309 and the second aperture 2311 are the same shape as the first aperture 1202 and the second aperture 1204 described above. Vertically-oriented ridges 2312 are formed on the base member and surround the first aperture 2309 and the second aperture 2311. The adjustment member 2306 is removably coupled to the base member 2302. The adjustment member includes a second flange 2314 that is oriented generally parallel to the first flange 2304 and a securement web 2316 that is oriented generally parallel to the base member 2302. The securement web 2316 includes an aperture 2318 that aligns in registry with, and is the same shape as, the second aperture 2311. In various embodiments, the aperture 2318 is in the shape of a horizontal slot thereby facilitating horizontal displacement of the adjustment member 2306. Such displacement of the adjustment member 2306 allows a spacing between the first flange 2304 and the second flange 2314 to be varied to, for example, accommodate mullions or other members of a variety of widths. While not specifically illustrated in FIGS. 11-25, curtain-wall anchors such as, for example, the curtain-wall anchor 1100 and the curtain-wall anchor 2300 could be configured for use with an arm assembly such as, for example, the arm assembly 105 illustrated in FIG. 4 and discussed hereinabove. Such an arm assembly may include one or more of the first arm 110 and the second arm 112 also illustrated in FIG. 4 and discussed hereinabove. Furthermore, FIGS. 11-25 have, by way of example, discussed the curtain-wall anchor 1100 and the curtain-wall anchor 2300 as including the first aperture 1202 that is an arcuate slot and the second aperture 1204 as a horizontal slot. In various embodiments, however, the first aperture 1202 and the second aperture 1204 may be any shape including, for example, round, a linear horizontal slot, a linear vertical slot, a linear angled slot, an arcuate slot, or any combination thereof including the configurations specifically shown in FIGS. 3A-3D and discussed hereinabove relative thereto.

Still referring to FIG. 24, the adjustment member 2306 includes vertically-oriented ridges 2320 on a side of the securement web 2316 facing the base member 2302. The vertically-oriented ridges 2320 engage the vertically-oriented ridges 2312 formed on the base member and prevent horizontal movement of the adjustable member 2306 relative to the base member when the curtain-wall anchor 2300 is placed under load. Vertically-oriented ridges 2322 are formed on an outward-facing side of the securement web 2316 and, along with the vertically-oriented ridges 2312 formed around the first aperture 2309, engage the locking washers 1808 to prevent movement of the base member 2302 relative to the anchor bolts 1108.

Figure 25:
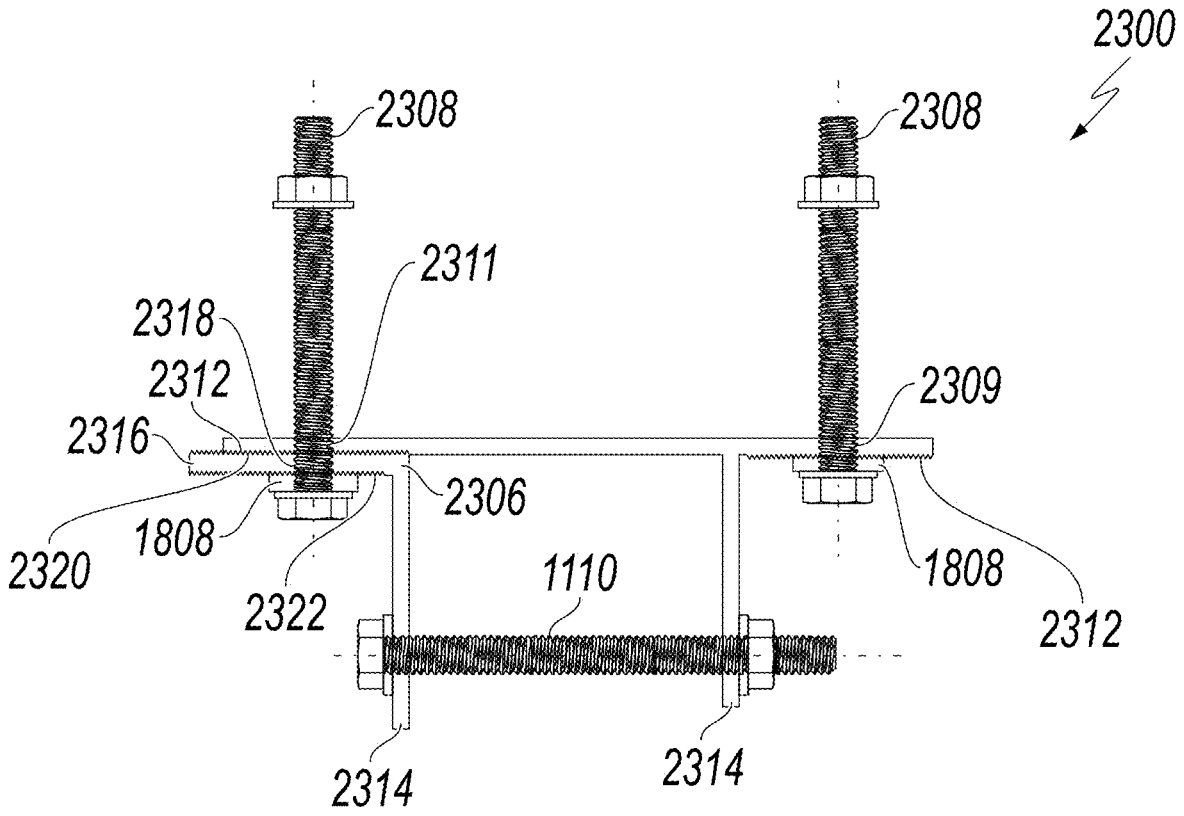
FIG. 25 is a top plan view of an alternative curtain-wall anchor having an adjustable flange.

Still referring to FIG. 24, vertically-oriented ridges 2322 may be formed on the outwardly-facing sides of the first flange 2304 and the second flange 2314. A locking washer 1808 may be positioned between at least one of the first flange 2304 and the second flange 2314 and the head region 1810 of the securement bolt 1110. The locking washer 1808 engages the vertically-oriented ridges 2322 and prevents horizontal and vertical movement of the securement bolt 1110 relative to the first flange 2304 and the second flange 2314. FIG. 25 is a plan view of the curtain-wall anchor 2300 illustrating that, in various embodiments, the vertically-oriented ridges 2322 may be omitted from one or both of the first flange 2304 and the second flange 2314.

Any suitable combination of various embodiments, or the features thereof, is contemplated. For example, any of the embodiments of the curtain-wall anchor disclosed herein can include features of other embodiments. Thus, any embodiment of the curtain-wall anchor disclosed herein may include the aperture configurations shown in FIGS. 3A-3E and FIGS. 12A-12B and discussed hereinabove. Similarly, the arm assembly 105 having a first arm 110 and a second arm 112, shown in FIG. 4 and discussed hereinabove may or may not be included in any of the embodiments of the curtain-wall anchor disclosed herein. In like fashion, any of the curtain-wall anchors disclosed herein could be secured to a building structure formed of, for example, a composite slab, timber, including mass timber, or a metallic material. Such securement of any of the embodiments of the curtain-wall anchor disclosed herein to the building structure may or may not utilize a channel.

Depending on the embodiment, certain acts, events, or functions of any of the methods or processes described herein can be performed in a different sequence, can be added, merged, or left out altogether (e.g., not all described acts or events are necessary for the practice of the methods or processes). Moreover, in certain embodiments, acts or events can be performed concurrently.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices illustrated can be made without departing from the spirit of the disclosure. As will be recognized, the processes described herein can be embodied within a form that does not provide all of the features and benefits set forth herein, as some features can be used or practiced separately from others. The scope of protection is defined by the appended claims rather than by the foregoing description. All changes which come within the meaning and range of equivalency of the claims are to be embraced within their scope.

What is claimed is:

1. A curtain-wall anchor, comprising:

a back member having a first arcuate slotted aperture and a second aperture formed therein, the first arcuate slotted aperture receiving a first mounting bolt and the second aperture receiving a second mounting bolt;

a first plurality of vertically-oriented ridges formed in the back member proximate the first arcuate slotted aperture and the second aperture such that the first arcuate slotted aperture is oriented at a non-perpendicular angle relative to the first plurality of vertically-oriented ridges;

a flange having a first portion that is arranged parallel to the back member and a first arm that is arranged perpendicular to the first portion, the first portion having a second plurality of vertically-oriented ridges that are complementary to the first plurality of vertically-oriented ridges, the first portion having a third plurality of vertically-oriented ridges disposed on a face opposite the second plurality of vertically-oriented ridges;

a first locking washer that is received onto the first mounting bolt, the first locking washer having a fourth plurality of vertically-oriented ridges that are complementary to the third plurality of vertically-oriented ridges formed in the back member.

2. The curtain-wall anchor of claim 1, wherein the second aperture is a horizontal slot.

3. The curtain-wall anchor of claim 1, wherein the second aperture is an angled slot.

4. The curtain-wall anchor of claim 1, comprising:

a second arm extending from the back member.

5. The curtain-wall anchor of claim 4, wherein at least one of the first arm and the second arm comprises a plurality of jointed members.

6. The curtain-wall anchor of claim 5, wherein at the flange is slidably coupled to the back member.

7. A curtain-wall anchor, comprising:

a back member having a first arcuate slotted aperture and a second aperture formed therein, the first arcuate slotted aperture receiving a first mounting bolt and the second aperture receiving a second mounting bolt;

a first plurality of vertically-oriented ridges formed in the back member proximate the first arcuate slotted aperture and the second aperture such that the first arcuate slotted aperture is oriented at a non-perpendicular angle relative to the first plurality of vertically-oriented ridges;

a first locking washer that is received onto the first mounting bolt, the first locking washer having a second plurality of vertically-oriented ridges that are complementary to the first plurality of vertically-oriented ridges formed in the back member.

8. The curtain-wall anchor of claim 7, wherein the second aperture is a horizontal slot.

9. The curtain-wall anchor of claim 7, wherein the second aperture is an angled slot.

10. The curtain-wall anchor of claim 7, comprising:

a first arm extending from the back member; and a second arm extending from the back member in a spaced relationship to the first arm.

11. The curtain-wall anchor of claim 10, wherein at least one of the first arm and the second arm comprises a plurality of jointed members.

12. The curtain-wall anchor of claim 11, wherein at least one of the first arm and the second arm are slidably coupled to the back member.

13. The curtain-wall anchor of claim 12, wherein at least one of the first arm and the second arm is coupled to the back member via at least one of the first mounting bolt and the second mounting bolt.

14. The curtain-wall anchor of claim 13, wherein the at least one of the first arm and the second arm comprises a fourth plurality of vertically-oriented ridges that are complementary to the first plurality of vertically-oriented ridges.

15. A method of installing a curtain-wall anchor, the method comprising:

securing a back member to a building structure with a first mounting bolt that is received through a first arcuate slotted aperture formed in the back member and with a second mounting bolt that is received through a second aperture formed in the back member, the back member having a first plurality of vertically-oriented ridges formed therein such that the first arcuate slotted aperture is oriented at a non-perpendicular angle relative to the first plurality of vertically-oriented ridges;

adjusting, via the first arcuate slotted aperture, an angular position of the back member to a select angular position relative to the building structure;

adjusting a lateral position of a flange having a first portion that is arranged parallel to the back member and a first arm that is arranged perpendicular to the first portion, the first portion having a second plurality of vertically-oriented ridges that are complementary to the first plurality of vertically-oriented ridges, the first portion having a third plurality of vertically-oriented ridges disposed on a face opposite the second plurality of vertically-oriented ridges; and securing the back member in the select angular position relative to the building structure utilizing a first locking washer, the first locking washer comprising a fourth plurality of vertically-oriented ridges that are complementary to the third plurality of vertically-oriented ridges.

16. The method of claim 15, wherein the back member is secured to a top surface of the building structure.

17. The method of claim 15, wherein the back member is secured to a front surface of the building structure.

* * * * *